US009748048B2

(12) United States Patent
Fitzgerald et al.

(10) Patent No.: US 9,748,048 B2
(45) Date of Patent: Aug. 29, 2017

(54) MEMS SWITCH

(71) Applicant: Analog Devices Global, Hamilton (BM)

(72) Inventors: Padraig L. Fitzgerald, Mallow (IE); Jo-ey Wong, Wayland, MA (US); Raymond C. Goggin, Watergrasshill (IE); Bernard P. Stenson, County Limerick (IE); Paul Lambkin, Raheen (IE); Mark Schirmer, Stoughton, MA (US)

(73) Assignee: Analog Devices Global, Hamilton (BM)

( * ) Notice: Subject to any disclaimer, the term of this patent is extended or adjusted under 35 U.S.C. 154(b) by 0 days.

(21) Appl. No.: 14/262,188

(22) Filed: Apr. 25, 2014

(65) Prior Publication Data

US 2015/0311003 A1 Oct. 29, 2015

(51) Int. Cl.

*H01H 57/00* (2006.01)
*H01H 1/00* (2006.01)
*H01H 59/00* (2006.01)

(52) U.S. Cl.

CPC ..... *H01H 1/0036* (2013.01); *H01H 59/0009* (2013.01); *H01H 2001/0084* (2013.01); *H01H 2059/0018* (2013.01)

(58) Field of Classification Search

CPC ... B81B 3/0081; B81B 3/0002; B81B 3/0008; B81B 3/001; B81B 3/0013; B81B 3/0016; B81B 3/0072; B81B 3/0078

USPC ..... 200/181, 283; 361/233; 335/78

See application file for complete search history.

(56) References Cited

U.S. PATENT DOCUMENTS

| | | | | |
|---|---|---|---|---|
| 688,235 | A * | 12/1901 | Ma | G09B 27/02 434/290 |
| 4,030,943 | A | 6/1977 | Lee et al. | 148/1.5 |
| 6,046,659 | A | 4/2000 | Loo et al. | |
| 6,115,231 | A | 9/2000 | Shirakawa | |
| 6,153,839 | A | 11/2000 | Zavracky et al. | |
| 6,377,438 | B1 | 4/2002 | Deane et al. | 361/278 |
| 6,384,353 | B1 * | 5/2002 | Huang | B81B 7/007 200/181 |
| 6,635,506 | B2 | 10/2003 | Volant et al. | 438/52 |
| 6,657,759 | B2 * | 12/2003 | Muller | B81B 3/0016 359/199.2 |
| 6,853,072 | B2 | 2/2005 | Asano et al. | 257/728 |

(Continued)

FOREIGN PATENT DOCUMENTS

| | | | |
|---|---|---|---|
| CN | 1575506 A | 2/2005 | H01L 21/20 |
| CN | 101226856 A | 7/2008 | H01H 59/00 |

(Continued)

OTHER PUBLICATIONS

Maciel et al. "High-Reliability MEMS Switches for Wireless Applications," presented at 2010 iMAPS New England—37th Symposium & Expo—Boxborough, MA, 26 pages, May 4, 2010.

(Continued)

*Primary Examiner* — Vanessa Girardi
(74) *Attorney, Agent, or Firm* — Wolf, Greenfield & Sacks, P.C.

(57) ABSTRACT

Several features are disclosed that improve the operating performance of MEMS switches such that they exhibit improved in-service life and better control over switching on and off.

32 Claims, 24 Drawing Sheets

(56) References Cited

U.S. PATENT DOCUMENTS

| | | | | |
|---|---|---|---|---|
| 7,106,066 | B2 * | 9/2006 | Ivanciw | H01H 1/0015 307/137 |
| 7,280,015 | B1 * | 10/2007 | Schaffner | H01H 59/0009 200/181 |
| 7,411,261 | B2 * | 8/2008 | Lee | B81B 3/0078 257/254 |
| 7,705,254 | B2 * | 4/2010 | Kim | H01H 59/0009 200/181 |
| 7,755,459 | B2 | 7/2010 | Nguyen et al. | 333/262 |
| 7,943,411 | B2 | 5/2011 | Martin et al. | 438/50 |
| 7,978,451 | B2 * | 7/2011 | Mergens | H01L 27/0251 361/111 |
| 2004/0008097 | A1 | 1/2004 | Ma et al. | 333/262 |
| 2005/0099252 | A1 * | 5/2005 | Isobe | H01P 1/127 335/78 |
| 2005/0184836 | A1 | 8/2005 | Chou | 333/262 |
| 2006/0086597 | A1 | 4/2006 | Lee et al. | 200/200 |
| 2009/0160584 | A1 | 6/2009 | Premerlani et al. | 333/262 |
| 2010/0320606 | A1 | 12/2010 | Jain et al. | 257/751 |
| 2011/0147861 | A1 | 6/2011 | Steeneken et al. | 257/415 |
| 2011/0315526 | A1 | 12/2011 | Jahnes et al. | 200/181 |
| 2012/0313189 | A1 | 12/2012 | Huang et al. | 275/415 |
| 2013/0140155 | A1 | 6/2013 | Urvas et al. | 200/181 |
| 2015/0311021 | A1 | 10/2015 | Lee et al. | |

FOREIGN PATENT DOCUMENTS

| | | | | |
|---|---|---|---|---|
| DE | 41 13 190 | C1 | 7/1992 | H01H 59/00 |
| DE | 41 13 190 | C1 | 7/2016 | H01H 59/00 |
| EP | 0 255 911 | A2 | 2/1988 | H01L 23/52 |
| EP | 2 743 955 | A1 | 6/2014 | H01H 59/00 |
| JP | 2009-9884 | A | 1/2009 | H01H 49/00 |
| JP | 2009-152196 | | 7/2009 | H01H 59/00 |
| JP | 2011-146403 | | 7/2011 | H01H 59/00 |
| WO | WO 2008/033213 | A2 | 3/2008 | H01H 59/00 |
| WO | WO 2009/147600 | A1 | 12/2009 | H01H 59/00 |
| WO | WO 2013/024658 | A1 | 2/2013 | H01H 59/00 |

OTHER PUBLICATIONS

Official Action; Notice of Reasons for Rejection; Japanese Patent Application No. 2105-089553; 7 pages, Feb. 25, 2016.

Official Action; Notice of Reasons for Rejection; Japanese Patent Application No. 2105-089553; 9 pages, Feb. 25, 2016 (*English Translation of AW*).

Extended European Search Report, Application No. 15164102.4-1808/3054469, 8 pages, Jul. 16, 2016.

U.S. Appl. No. 14/278,362, filed May 15, 2014, MEMS Switch with Internal Conductive Path, Lee et al.

Japan Patent Office, Penultimate Office Action—Notice of Reasons for Rejection: Application No. 2015-089553, dated Dec. 22, 2016, 5 pages (*English translation*).

* cited by examiner

MEMS SWITCH

FIELD

This disclosure relates to improvements in micro-electro-mechanical components such as switches.

BACKGROUND

Micro-electro-mechanical systems (MEMS) allow components such as switches, gyroscopes, microphones, strain gauges and many sensor components to be formed on a small scale compatible with including these components within an integrated circuit package.

MEMS components can be formed on a substrate, such as a silicon wafer, using the same processes as used in the formation of integrated circuits. This disclosure provides improvements in the manufacture of MEMS components, and in particular to MEMS switches.

SUMMARY

In a first aspect, this documents discloses a MEMS component, comprising:

a substrate; a support; a movable structure; and a control electrode. The support extends from the substrate and holds a first portion of the movable structure adjacent the substrate, and the movable structure overlaps with the control electrode, wherein the movable structure is delimited by an edge, and the control electrode extends past the edge of the movable structure.

The movable structure may extend away from the support. In some variations the movable structure is attached to the support to form, for example, a cantilever or a beam, whereas in other variations intermediate arms may extend between the support and the movable structure.

In use, electrostatic fields around the control electrode can cause charge to be trapped in the substrate where the substrate includes a dielectric. Extending the control electrode beyond the end or side of the movable structure increases a distance between any trapped charge and the movable structure. This means that, where for example the MEMS component is a switch, opening of the switch becomes more reliable.

Advantageously the movable structure may be pivotably mounted to the support and may extend either side of it. Such an arrangement is analogous to a see-saw, although there is no requirement for the individual sides of the see-saw to be the same length in this context. In such an arrangement each side of the support may be associated with a respective control electrode, so as to be able to pull either side of the movable structure towards the substrate. Pulling one side down causes the other side of the "see-saw" to lift, thereby providing the ability to actively pull the switch open.

In a second aspect of this disclosure there is disclosed a MEMS component comprising a deformable structure supported at a first position by a support, the deformable structure carrying a contact for making contact with a further contact surface and passing adjacent but separated from a control electrode. A potential difference between the control electrode and the deformable structure exerts a force on the deformable structure causing it to deform, wherein the deformable structure is modified to limit the peak stress occurring in the deformable structure.

Limiting peak stress reduces the risk of the materials used in the component yielding under the forces experienced within the component.

In a third aspect there is disclosed a MEMS switch, comprising: a substrate; a support; a movable structure; and a control electrode arranged such that the movable structure is held by the support above the substrate and extends over the control electrode. At least one of the substrate and the movable structure has at least one structure formed thereon to hold the movable structure spaced apart from the control electrode during use.

In use, overdrive voltages or yielding of materials may urge the movable structure to bend in a way that makes it touch the control electrode. The provision of at least one structure to prevent this obviates such problems.

In a fourth aspect there is disclosed a MEMS component, comprising: a substrate having a first coefficient of thermal expansion; and a support extending from the structure and having a second coefficient of thermal expansion. The MEMS component further comprises an expansion modification structure formed at or adjacent an interface between the substrate and the support, and having a third coefficient of expansion greater than the first coefficient of expansion, and the expansion modification structure is arranged to exert a thermal expansion force on the substrate in the vicinity of the interface so as to simulate a fourth coefficient of expansion different from the first coefficient in the substrate in the vicinity of the interface.

Differential thermal expansion can cause forces to occur within the support that deform it and ultimately affect the orientation of component or elements attached to the support. The use of an expansion modification structure can reduce such effects.

In a fifth aspect there is disclosed a MEMS component having a support extending upwardly from a substrate and carrying a structure that extends over a surface of the substrate or over a depression formed in the substrate, and wherein the structure is provided with a plurality of slots and/or apertures therein to facilitate chemical removal of material from beneath the structure.

Failure to remove sacrificial material during manufacture can reduce component yields. Provision of apertures for etchant to penetrate the device improves yield.

In a sixth aspect there is disclosed a MEMS switch comprising: a substrate; a support; and a switch member supported by the support at a position such that a portion of the switch member extends away from the support in a first direction towards a first switch contact and over a first control electrode. The MEMS switch further comprises a second control electrode adjacent a portion of the switch member such that an attractive force acting between the second control electrode and the switch member urges the switch member to move away from the first switch contact.

The provision of control electrodes to provide active opening and closing of the switch enhances the reliability of operation. For a normally closed switch where stress has been induced in the switch member during manufacture or dimensions varied such that the switch is normally closed, the first control electrode may be omitted so that the switch can be actively driven open but closes in response to removal of the control voltage from the second control electrode.

The movable structure or switch member may notionally be considered as having first and second portions disposed on opposite sides of the support. This allows the attractive forces between the switch member and the second control electrode to act in opposition to the attractive forces between the switch member and the first electrode. The relative strength of the forces can be varied by controlling the relative widths of the control electrodes, their separation from the switch member, their separation from the support, the voltage supplied or any combination of these parameters.

In some embodiments the second control electrode may be connected to the first control electrode by a high impedance such that the voltage on the second control electrode lags the voltage on the first control electrode. The large impedance connecting the electrodes and the capacitance of the second electrode form an RC filter. Thus once a control voltage has been applied to the first electrode to close the switch, the second electrode starts to charge thereby providing an opening force which is selected to be insufficient to open the switch whilst a holding voltage is applied to the first control electrode. Once the drive signal is removed from the first electrode, it takes a while for the voltage on the second electrode to decay away, and during this time the attractive force between the second control electrode and the switch member opens the switch such that a conductive path no longer exists to the first switch contact.

In a seventh aspect this document further discloses a MEMS switch comprising: a first switch contact; a second switch contact; a control electrode; a substrate; a support; a spring; and a conduction element. The support is formed away from the first and second switch contacts, and the spring extends from the support towards the first and second switch contacts, and carries the conduction element such that it is held above but spaced from at least one of the first and second contacts, and the spring and/or the conduction element pass adjacent to the control electrode.

It is thus possible to decouple the mechanical properties required of the spring from the mechanical properties required of the conduction element.

Two or more of the various aspects may occur in combination in a single embodiment.

Thus, for example, the use of a spring carrying the conduction element may occur in combination with an enlarged electrode of the first aspect, and/or with the features to limit peak stress, and/or the see-saw design of the sixth aspect.

BRIEF DESCRIPTION OF THE DRAWINGS

MEMS structures constituting embodiments of this disclosure will now be described by way of non-limiting example with reference to the accompanying figures, in which.

DESCRIPTION OF SOME EMBODIMENTS

Micro mechanical machined systems (MEMS) components are known to the person skilled in the art. Commonplace examples of such components are solid state gyroscopes and solid state accelerometers.

Switches are also available in MEMS technology. In principle a MEMS switch should provide a long and reliable operating life. However such devices tend not to exhibit the operating life that might have been expected. This disclosure results from an investigation and identification of processes that occur within a MEMS switch. The teachings of this document will be relevant to other MEMS devices.

Figure 1:
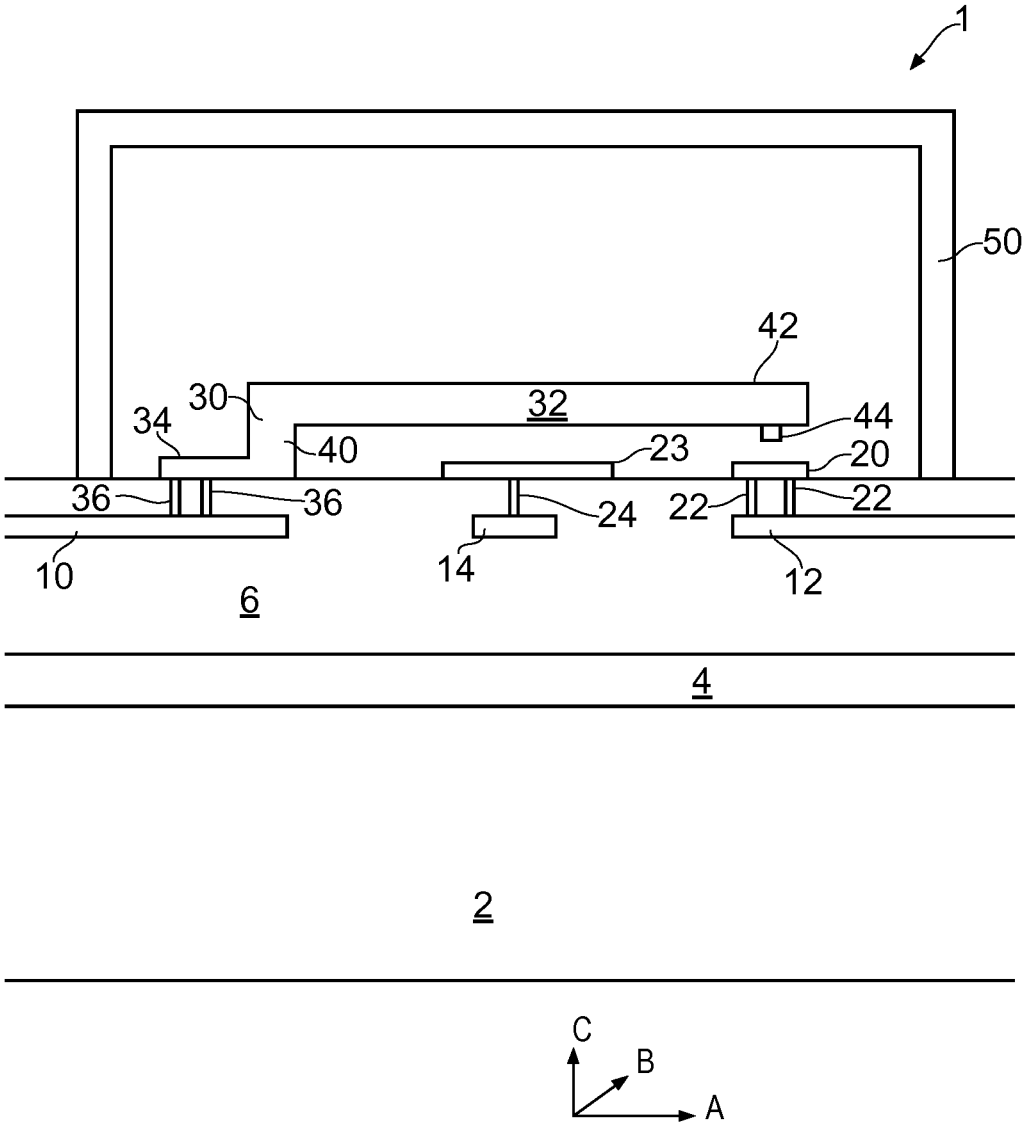
FIG. 1 is a cross section through a MEMS switch.

FIG. 1 is a schematic diagram of a MEMS switch generally indicated 1. The switch 1 is formed over a substrate 2. The substrate 2 may be a semiconductor, such as silicon. The silicon substrate may be a wafer formed by processes such as the Czochralski, CZ, process or the float zone process. The CZ process is less expensive and gives rise to a silicon substrate which is more physically robust than that obtained using the float zone process, but float zone delivers silicon with a higher resistivity which is more suitable for use in high frequency circuits.

The silicon substrate may optionally be covered by a layer 4 of undoped polysilicon. The layer 4 of polysilicon acts as a carrier lifetime killer. This enables the high frequency performance of the CZ silicon to be improved.

A dielectric layer 6, which may be of silicon oxide (generally $SiO_2$) is formed over the substrate 2 and the optional polysilicon layer 4. The dielectric layer 6 may be formed in two phases such that a metal layer may be deposited, masked and etched to form conductors 10, 12 and 14. Then the second phase of deposition of the dielectric 6 may be performed so as to form the structure shown in FIG. 1 in which the conductors 10, 12 and 14 are embedded within the dielectric layer 6.

The surface of the dielectric layer 6 has a first switch contact 20 provided by a relatively hard wearing conductor formed over a portion of the layer 6. The first switch contact 20 is connected to the conductor 12 by way of one or more vias 22. Similarly a control electrode 23 may be formed above the conductor 14 and be electrically connected to it by one or more vias 24.

A support 30 for a switch member 32 is also formed over the dielectric layer 6. The support 30 comprises a foot region 34 which is deposited above a selected portion of the layer 6 such that the foot region 34 is deposited over the conductor 10. The foot region 34 is connected to the conductor 10 by way of one or more vias 36.

In a typical MEMS switch the conductors 10, 12 and 14 may be made of a metal such as aluminum or copper. The vias may be made of aluminum, copper, tungsten or any other suitable metal or conductive material. The first switch contact 20 may be any suitable metal, but rhodium is often chosen as it is hard wearing. For ease of processing the control electrode may be made of the same material as the first switch contact 20 or the foot region 34. The foot region 34 may be made of a metal, such as gold.

The support 30 further comprises at least one upstanding part 40, for example in the form of a wall or a plurality of towers that extends away from the surface of the dielectric layer 6.

The switch member 32 forms a moveable structure that extends from an uppermost portion of the upstanding part 40. The switch member 32 is typically (but not necessarily) provided as a cantilever which extends in a first direction, shown in FIG. 1 as direction A, from the support 30 towards the first switch contact 20. An end portion 42 of the switch member 20 extends over the first switch contact 32 and carries a depending contact 44. The upstanding part 40 and the switch member 32 may be made of the same material as the foot region 34.

The MEMS structure may be protected by a cap structure 50 which is bonded to the surface of the dielectric layer 6 or other suitable structure so as to enclose the switch member 32 and the first switch contact 20. Suitable bonding techniques are known to the person skilled in the art.

The switch 1 can be used to replace relays and solid state transistor switches, such as FET switches. Many practitioners in the field have adopted a terminology that is used with FETs. Thus the conductor 10 may be referred to as a source, the conductor 12 may be referred to as a drain, and the conductor 23 forms a gate connected to a gate terminal 14. The source and drain may be swapped without affecting the operation of the switch.

In use a drive voltage is applied to the gate 23 from a drive circuit. The potential difference between the gate 23 and the switch member 32 causes, for example, positive charge on the surface of the gate 23 to attract negative charge on the lower surface of the cantilevered switch member 32. This causes a force to be exerted that pulls the switch member 32 towards the substrate 2. This force causes the switch member to bend such that the depending contact 44 contacts the first switch contact 20.

In practice, the switch is over driven so as to hold the contact 44 relatively firmly against the first switch contact 20.

However, such a switch exhibits several practical problems.

Firstly, if the switch is held closed (conducting) for several hours to a couple of days, then the switch may not open (go high impedance) when the gate signal is removed.

Secondly, the switch is affected by temperature, and generally becomes harder to close at low temperatures and easier to close as the temperature rises, until it closes in the absence of a control signal.

Thirdly in the closed state the switch may break down becoming inoperable.

These characteristics have inhibited the adoption of MEMS switches.

Opening and Closing

As noted above, the switch closes in response to an electrostatic force acting between the gate 23 and the switch member 32. The switch opens by the spring action of the switch member 32.

The spring or restoring force acting to open the switch is a function of the dimensions, such as width and depth of the material forming the switch member 32. The choice of material also makes a difference to the spring force. Dimensions and material of the upstanding part 30 and foot 34 can also affect the restoring force.

The closing force is a function of the voltage difference between the gate 23 and the switch member 32, and also the distance of the gate 23 from the support 30.

However other phenomena have been observed by the inventors that affect the closing force.

Figure 2:
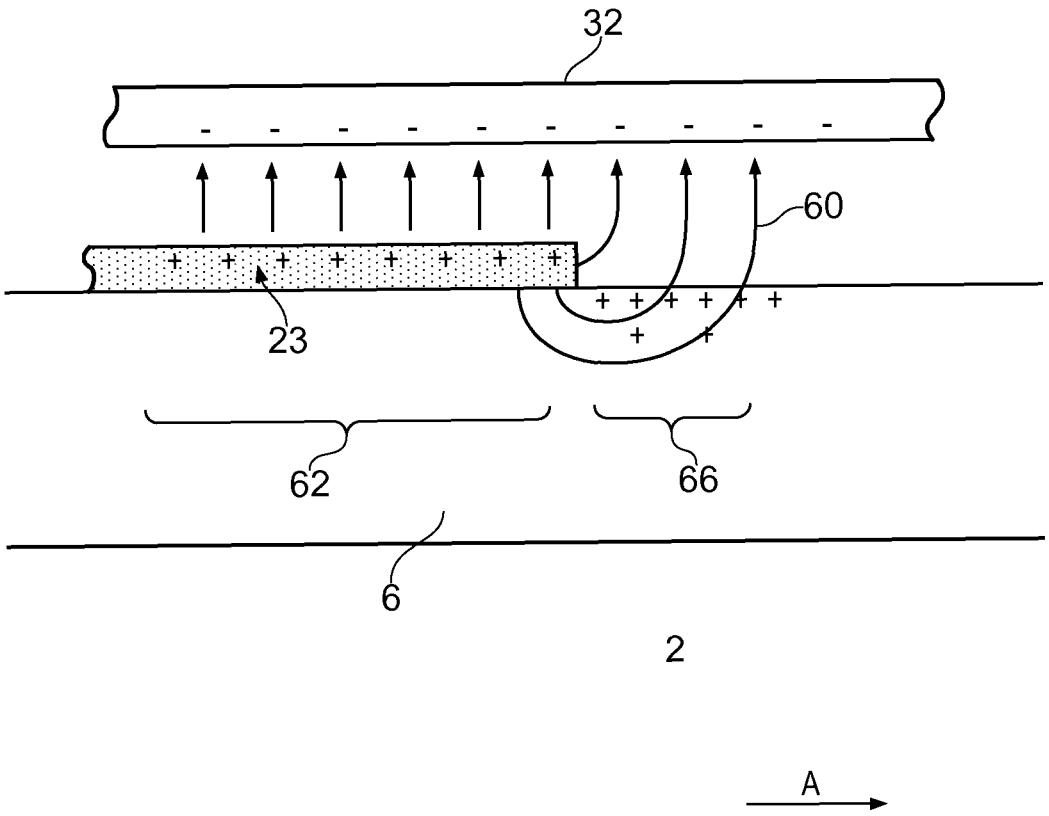
FIG. 2 schematically illustrates an E-field around the edge of the gate electrode.

FIG. 2 shows the gate 23 and switch member 32 together with lines of electric field around the gate electrode 32.

In the arrangement shown in FIG. 2 the gate 23 has been connected to a positive voltage such that it is positively charged compared to the switch member 32. In fact the user has a choice whether to drive the gate negative or positive and that may be decided by the ease of deriving a suitable gate voltage. Electric field vectors originate from the gate 23 and progress towards the switch member 32. Most of the attraction occurs in a region 62 where the gate is provided. The potential on the gate 23 also creates an electric field 60 in a region 66 adjacent to an edge of the gate electrode 23. This field can cause charge to accumulate in the dielectric layer 6 as schematically represented by the "+" symbols at region 66. The charge accumulates over several hours of the switch being driven into the closed state, and decays away over several hours once the gate voltage is removed.

The inventors realized that this mechanism was in operation, and that the size and shape of the metal forming the gate 23 may be modified to increase the distance between the region of trapped charge 62 and the switch member 32, thereby reducing this attractive force resulting from trapped charge. FIG. 2 also shows that layer 4 of undoped polysilicon can be omitted.

Reducing Charge Trapping

In order to reduce the undesirable closing force resulting from charges becoming trapped in the dielectric layer 6, the inventors realized it was desirable to reduce the area of exposed dielectric beneath the switch member 32. This can be achieved by increasing the size of the gate. The gate dimensions can be increased in a second dimension, indicated B in FIGS. 1 and 3, perpendicular to the plane of FIGS.

Figure 3:
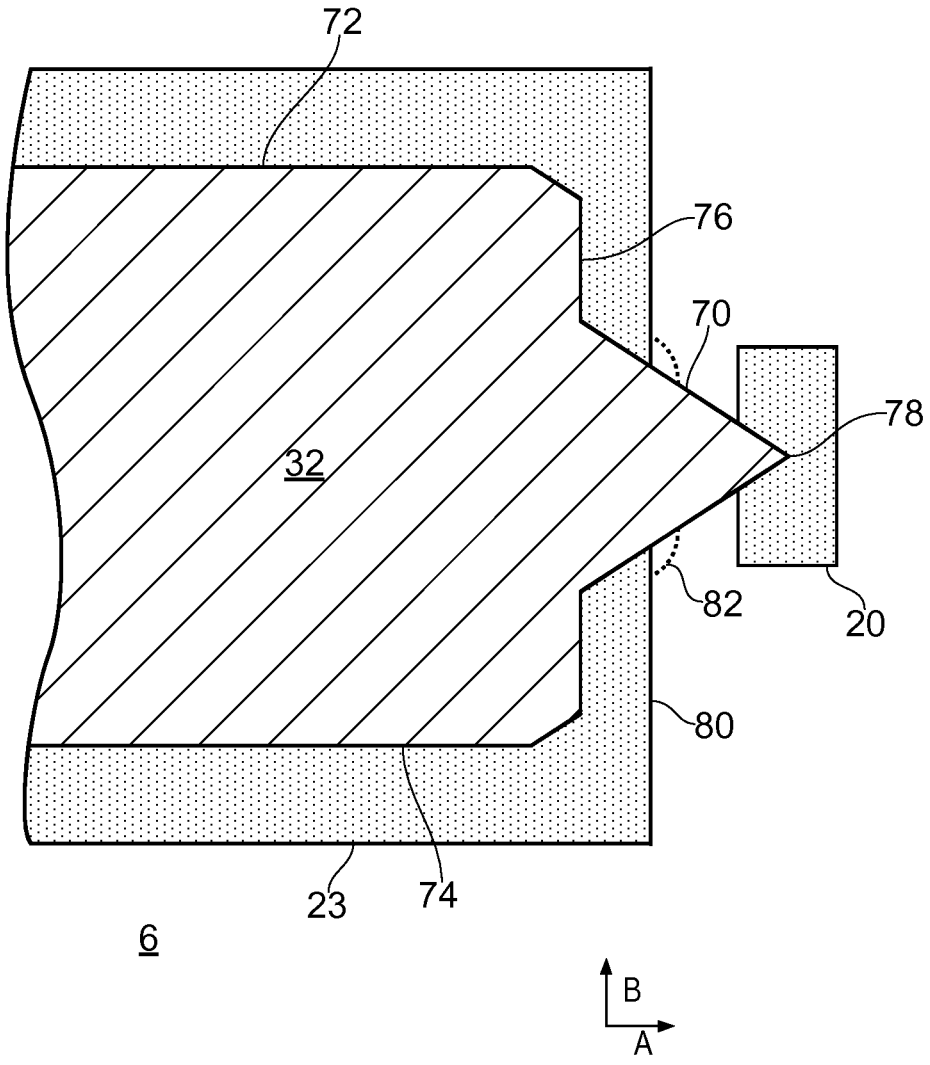
FIG. 3 is a plan view of a MEMS switch where the gate electrode extends beyond edges of the switch member.

1 and 2 such that the gate extends beyond the side edges of the switch member 32, as shown in FIG. 3. FIG. 3 is a plan view of part of the switch shown in FIG. 1. The switch member 32 is profiled so as to have a contact carrier portion 70 which extends from the switch member 32 and which defines a portion of the switch member 32 which extends beyond the spatial extent of the gate 23. Thus, if we consider the sides 72 and 74 of the switch member 32, these occur over the gate 23, and hence the gate extends past the sides 72 and 74 of the switch member 34 and shields the edges from the effects of charge trapping in the dielectric 6. Similarly a front edge 76 of the switch member 32 does not extend beyond the gate 23, except for contact carrier portion 70 which needs to reach the first switch contact 20.

This configuration means that only the charge build-up occurring adjacent a front edge 80 of the gate 23 in the region generally enclosed by chain line 82 is able to exert an attractive force on a contact carrier portion 70. This much reduced charge trapping interaction is sufficient to prevent the switch becoming "stuck on" when the gate voltage is removed. In tests concluded by the applicant in their in house test facility switches were driven "on" for several months, and successfully released when the gate voltages were removed. This is a significant improvement on prior art switches which can become stuck on after only a day or so.

Figure 4:
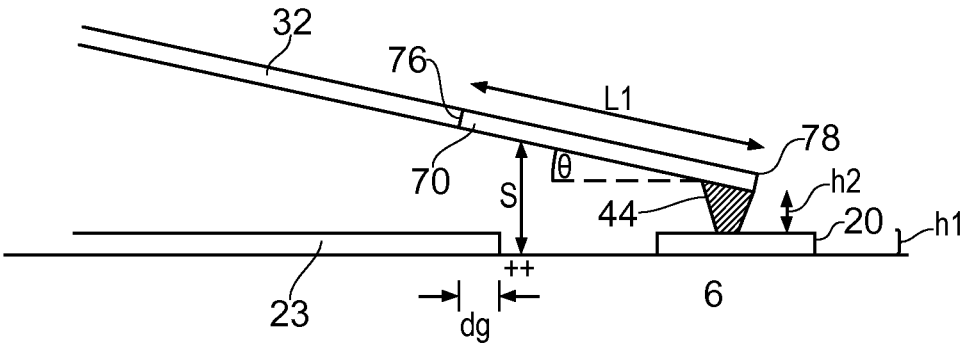
FIGS. 4 and 5 show how the length of a contact carrier and the length of a depending contact modify the separation between the gate and the switch member.
Figure 5:
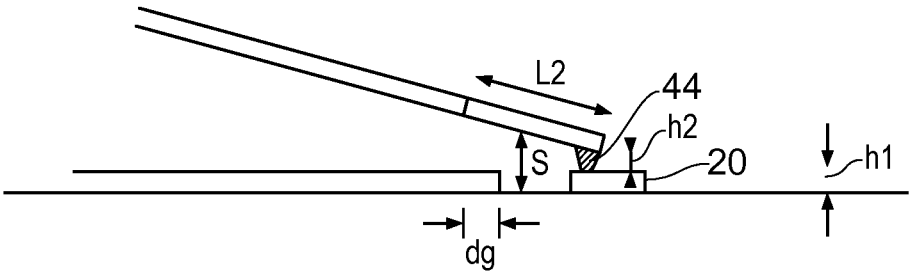

However, other design features of the switch shown in FIG. 3 also enhance its switch off performance. FIGS. 4 and 5 compare and contrast the effects of the length of the contact carrier portion 70, and the size of the depending contact 44.

In FIG. 4 and FIG. 5 the cantilever is at an angle θ with respect to the underlying substrate, and the first switch contact 20 has a height h1, and the contact 44 has a height h2.

In the arrangement shown in FIG. 4, the contact carrier 70 has a length L1 (between edge 76 and a carrier tip 78). The gate 23 extends past the front edge 76 by a guard distance dg. We can express the distance between contact carrier 70 and the potentially trapped charges in the dielectric 6, as represented in FIG. 4 by the "+" symbols at the front edge of the gate.

To a reasonable approximation, the separation distance S is $$S=(L1-dg)\sin\theta+h1+h2$$

It can be seen a longer length of the contact carrier 70 increases the distance S, and hence reduces the attractive force between the trapped charge and the carrier 70. Similarly increasing the contact height of the contact 44 also adds to the distance S, as does increasing the thickness of the metal used to form the first switch contact 20.

Thus, it can be seen that in FIG. 4 where the contact carrier 70 is relatively long, having a length L1 and has a relatively deep contact 44, the distance S is significantly bigger than that shown in FIG. 5 where the contact carrier 70 is shorter, with length L2 less than L1 and the contact height h2 of the contact 44 is also reduced.

It can also intuitively be seen that the attractive force which is a function of the separation between on the one hand the charge trapped in the region 66 of the dielectric 6 and on the other hand the switch member 32 and the contact carrier 70 may also be reduced by modifying the profile of the material of the switch member 32 and/or the contact carrier 70.

Figure 6:
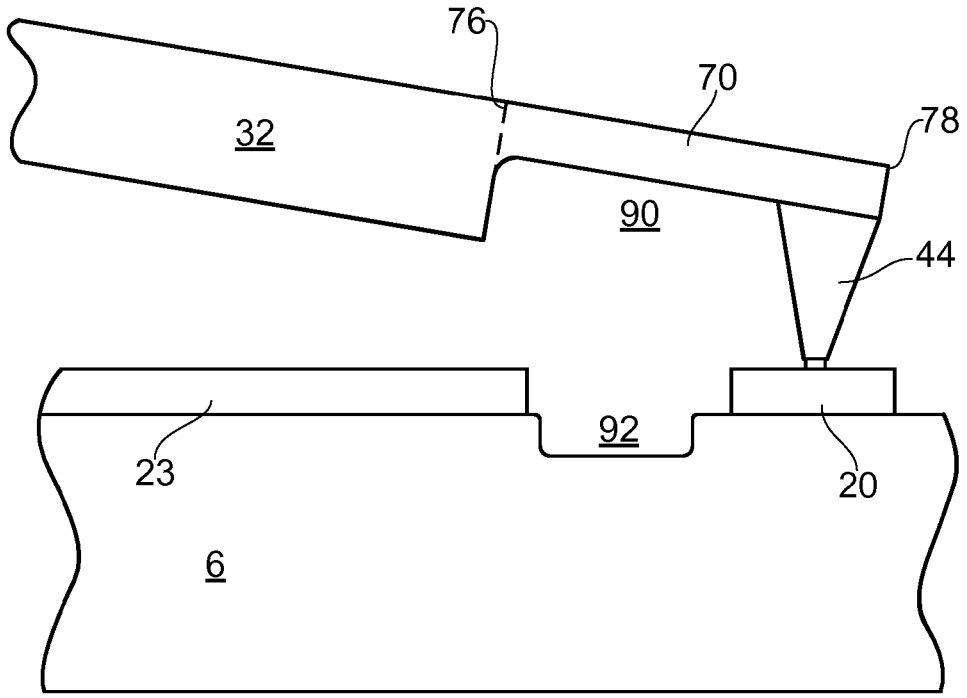
FIG. 6 shows further features for reducing the closing effect of trapped charge.

FIG. 6 shows an end portion of a switch member 32 which has been modified to reduce the depth of the metal forming the contact carrier 70 compared to the depth of the metal forming the switch member 32. The reduced thickness of metal creates a void 90 between the depending contact 44 and the main body of the switch member 32. This increases the distance between the substrate 6 and the metal of the contact carrier 70 thereby reducing the closing force exerted by trapped charge. Additionally or alternatively a recess 92 may be formed in the dielectric layer 6 between the gate electrode 23 and the first switch contact 20. This also serves to reduce the attractive force exerted by trapped charge.

Material Yield Under Stress

As noted before, the attractive force exerted by the gate voltage causes the cantilever switch member 32 to deform and in particular to bend. As the cantilever 32 starts to bend it gets closer to the gate electrode and so the attractive force increases. Further, for a low "on" resistance the depending contact 44 needs to be held against the first switch contact 20, and hence it is common to overdrive the switch.

Metals may yield under load such that they start to assume a modified shape. The rate of yield may also be affected by temperature.

Figure 7A:
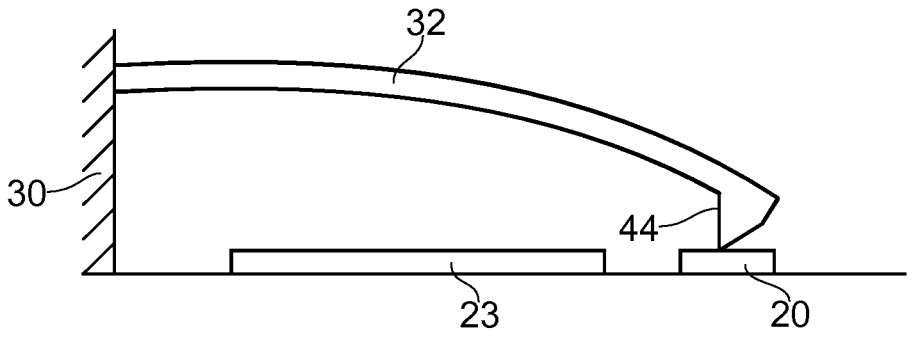
FIGS. 7*a* and 7*b* show profiles of the switch member under a switch closing force from the gate electrode.
Figure 7B:
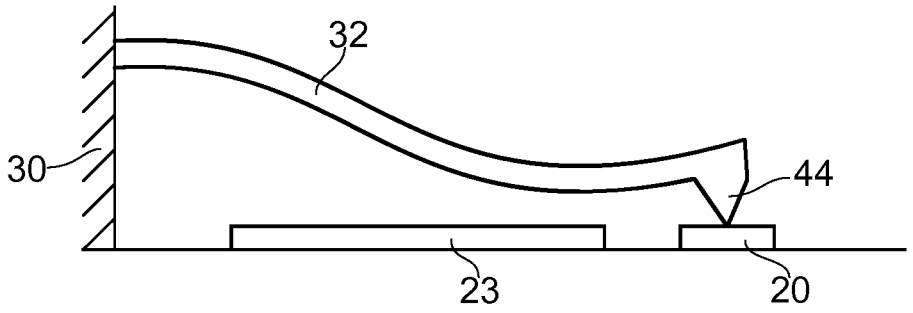

FIG. 7*a* shows the notional profile of a cantilevered switch member 32 in the closed position, and FIG. 7*b* schematically illustrates how the profile of the cantilevered switch member 32 may change over time as the material of the switch member 32 yields under the closing force exerted by the gate electrode 23.

In the arrangement shown in FIG. 7*a*, the height of the switch member 32 decreases smoothly with increasing distance from the support 30. However, the effect of yield, or indeed excessive overdrive, is to cause the switch member 32 to deflect excessively over the gate region 23. In the limit the switch member 32 may contact the gate 23, in which case current flow between the gate and the switch member may result in destruction of a drive circuit providing the gate voltage. This phenomenon can be described as "breakdown".

When the switch is open, and hence the depending contact 44 is not in contact with the first switch contact 20, the switch member 32 is a cantilever and hence its deflection can be estimated.

The analysis for the force on the switch member 32 is complex because the force at a given point depends on the local distance to the gate electrode.

However, to a first approximation starting from an ideal open position in which the cantilevered switch member 32 is parallel to the gate electrode 23 and the gate 23 is relatively expansive, then the switch member 32 approximates a uniformly loaded cantilever.

The deflection $d_B$ at the free end of a uniformly loaded cantilever can be approximated by $$d_B = \frac{qL^4}{8EI}$$

where: q is the force per unit length

L is the length of the beam

E is the modulus of elasticity

I is the area moment of inertia.

The stress in the switch member 32 can also be represented by an elastic flexure stress equation $$\sigma = \frac{m \cdot y}{I}$$

where: σ is the normal bending stress at a distance y from a "neutral surface"

m is the resisting moment in the section of the cantilever, and

I is the area moment of inertia.

$$I = \frac{wh^3}{12}$$

where: w is the width of the beam h is the vertical thickness of the beam.

Once the contacts 44 and 20 touch, then the situation becomes more complex and the nature of the deflection and becomes a blend of cantilever type deflection and the deflection of a loaded beam supported at opposing ends. This is because the force borne by the support 30 and the contacts acting as a support is not the same.

For a uniformly loaded beam supported by two simple supports the deflection D of the midpoint is given by $$D = \frac{5qL^4}{384EI}$$

The contacts 44 and 20 combine to approximate a simple support, but the interface between the switch member 32 and the support 30 does not. Thus none of the these equations accurately describe the deflection of the switch member 32 but they do provide useful insights into its behavior.

We should also note that once stress becomes excessive, the material of the beam permanently deforms.

The inventors realized that, for actuation stress 1) stress in the switch member 32 can be reduced by making the switch member 32 longer,
2) stress in the beam can be reduced by increasing the moment of inertia (also known as moment of area).

The inventors also realized that for overdrive stress 3) stress is reduced by moving actuation force towards the contact parts
4) stress is reduced by increasing the moment of inertia.

Consequently using a thicker and/or longer beam allows the restoring (opening) force to be maintained while reducing stress in the material, and hence reducing permanent deformation.

However, other solutions to controlling the stress may also be invoked, as set out earlier we can write:

$$\text{Stress } \sigma = \frac{m \cdot y}{I}$$

$$\text{and } I = \frac{w \cdot h^3}{12}.$$

Thus modifying the width of the beam changes the stress in the beam. It can be seen that if the width of the beam is reduced by half approximately half way down the beam, then the stress at this point will double. However the stress will tend to equalize out along the beam reducing the peak stress.

Figure 8A:
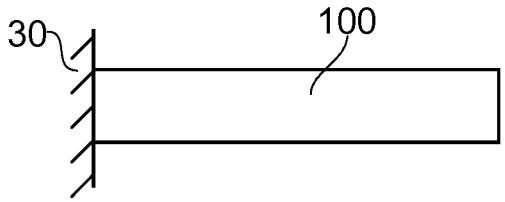
FIGS. 8*a* and 8*b* show plan views of embodiments of switch members.
Figure 8B:
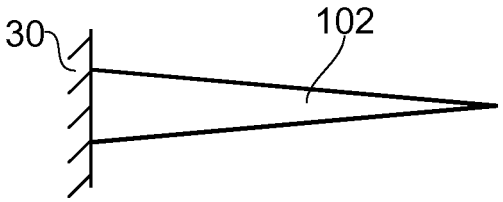
Figure 8C:
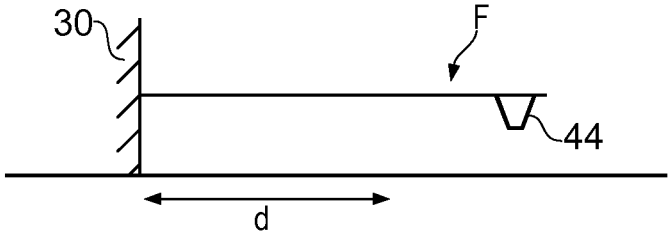
FIG. 8*c* shows a side view of the switch members of FIGS. 8*a* and 8*b*.

To put this in context, FIG. 8*a* shows a plan view of a straight sided cantilever 100, whereas FIG. 8*b* shows a plan view of a tapered cantilever 102 which tapers linearly to a point. The cantilevers 100 and 102 have the same side profile, as represented in FIG. 8*c*.

Figure 8D:
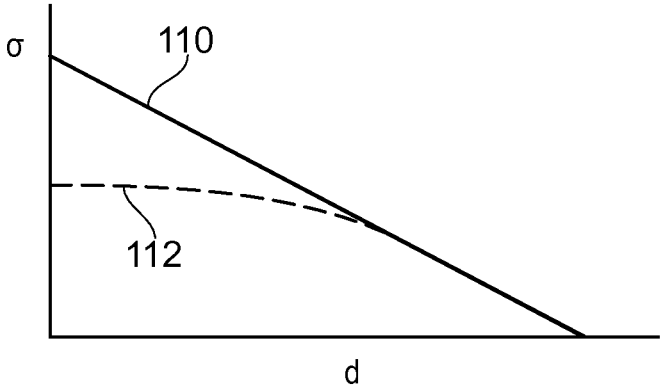
FIG. 8*d* compares strain in the switch members of FIGS. 8*a* and 8*b* as a function of position.

FIG. 8*d* shows a plot of stress in the cantilever beam as a function of distance. The stress in the straight sided beam 100 is represented by line 110. The stress varies linearly from a maximum value at the support 30 to zero at the tip. The stress in the tapered beam is represented by line 112, which exhibits a lower maximum value. The tapering need not be linear, and a substantial portion of the beam may be untapered.

Whilst longer beams reduce the closing force, and thicker beams reduce the risk of the beam deforming, other techniques can be used to modify the design of the switch member 32 to improve its actuation performance and to guard against collapse where the switch member touches the gate.

One way to reduce the risk of such contact is to increase the length of the depending tip 44. This immediately means that the switch member can undergo more distortion of the type illustrated in FIG. 7*b* before contact occurs.

Additionally or alternatively other measures may be taken including a) the formation of one or more support structures on the beam or the substrate to inhibit beam collapse,
b) use of a thicker switch member 32,
c) provision of a dielectric between the gate and the switch member 32.

Figure 9:
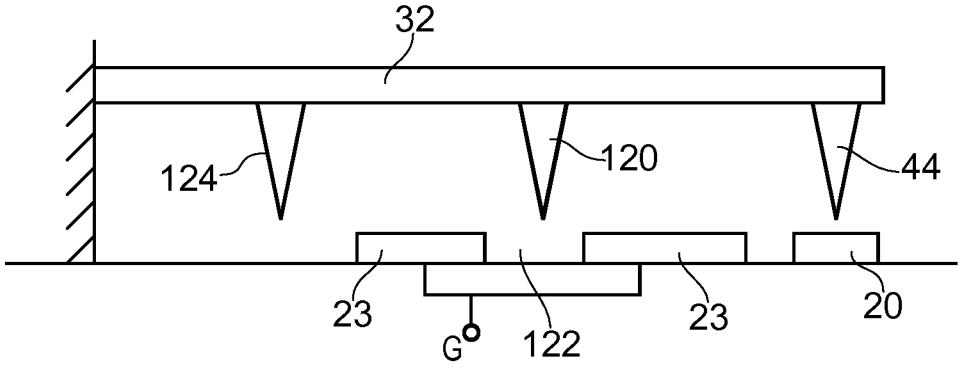
FIG. 9 is a cross section of an embodiment of a MEMS switch having additional supports formed to reduce the risk of the switch member touching the gate electrode.
Figure 10:
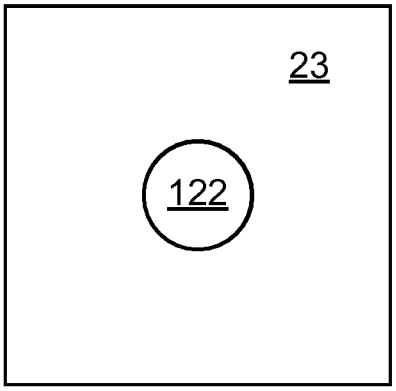
FIG. 10 is a plan view of a modified gate electrode for use with the arrangement shown in FIG. 9.

FIG. 9 schematically shows a cantilever switch member 32 having one or more additional supports 120. The supports 120 can be regarded as bumpers and may be formed using the same processing steps that are used to form the depending contact 44 and hence do not incur additional processing steps. One or more supports (bumpers) 120 may be provided in whatever pattern and spacing the designer feels appropriate to guard against collapse of the switch member 32 onto the gate. The support 120 is in electrical contact with the switch member 32 so it must not contact with the gate electrode 23. Consequently the gate electrode configuration may need to be modified to guard against such contact by removing portions of the gate adjacent the or each additional support 120. Thus in FIG. 9 a gap 122 is formed in the gate 23 beneath the support 120. Such a gap may be formed by an aperture etched into the gate 23, as schematically illustrated in FIG. 10.

Additionally or alternatively supports 124 may be provided beyond the edge of the gate 23. The supports may be provided as pin or column like structures as illustrated in FIG. 9, but they are not limited to such a shape. For example the supports may be elongate and take the form of walls if desired.

The supports, when they touch the substrate, reduce the unsupported span of the switch member 32. This significantly reduces the risk of breakdown since the deflection of beam supported by two supports is proportional to $L^4$ where L is the distance between the supports.

Figure 11:
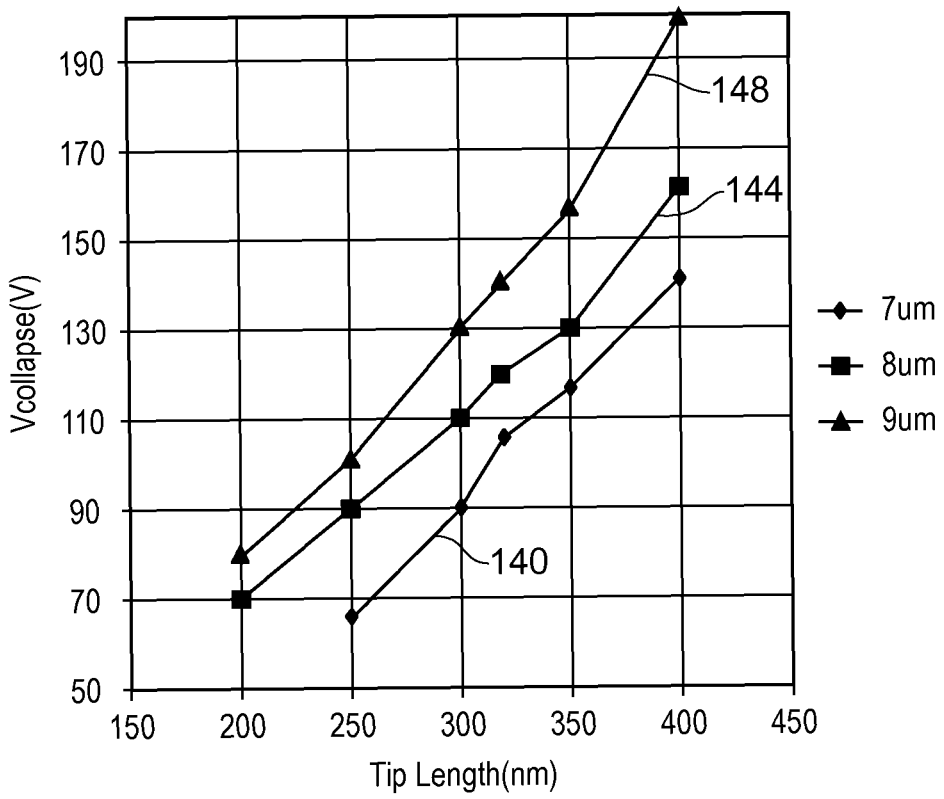
FIG. 11 is a graph showing gate to source voltage at which the switch member touches the gate for a cantilevered gold switch member of 95 μm length, for thicknesses of 7 μm, 8 μm and 9 μm and depending tip lengths of 200 nm to 400 nm.

As noted, contact height and beam thickness also have a significant effect. This was investigated experimentally for a cantilever beam having a span of 95 μm, and heights of the depending contact from 200 nm to 400 nm for cantilevers having thicknesses of 7, 8 and 9 μm made of gold. The breakdown voltage ranged from about 65V for the 7 μm thick cantilever with a 200 nm contact depth to 198V for the 9 μm thick cantilever with a 400 nm contact depth. This data is shown graphically in FIG. 11 with the 7 μm cantilever represented by line 140, the 8 μm thick cantilever by line 144 and the 9 μm this cantilever by line 148.

Figure 12:
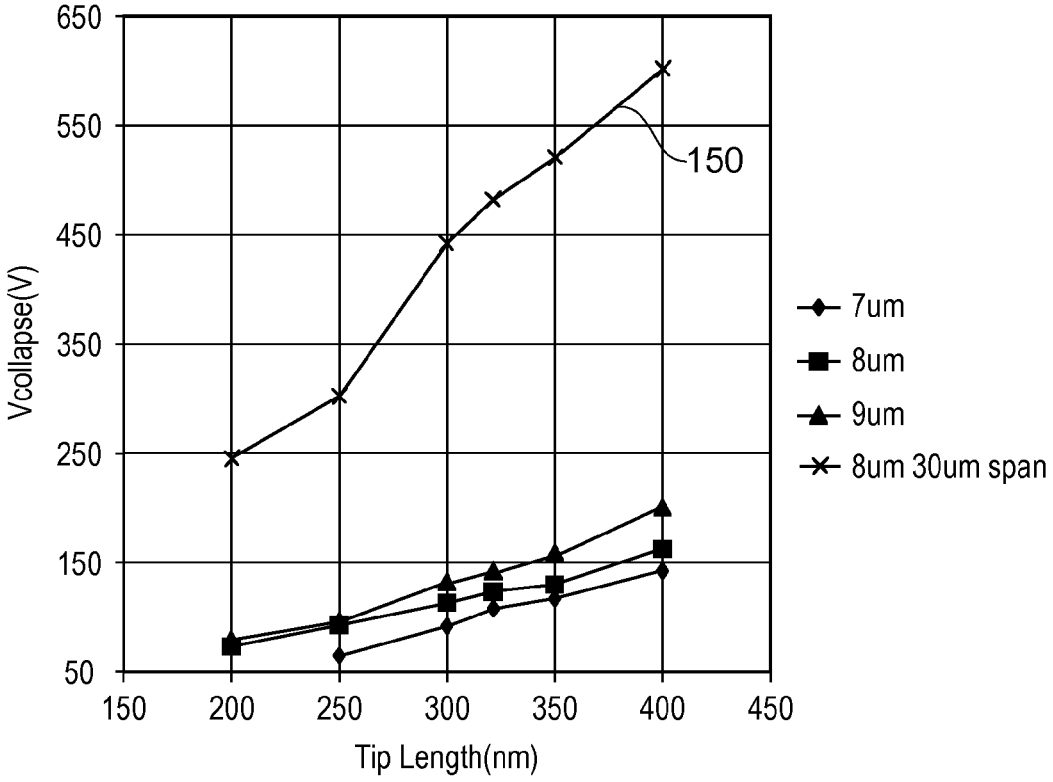
FIG. 12 repeats the data shown in FIG. 11, with the inclusion of additional data for an 8 μm thick cantilever of length 30 μm.

By shortening the span of the 8 μm thick cantilever to 30 μm the breakdown voltage at which the cantilever collapses onto the gate was increased to 240 volts for a 200 nm contact 44 up to 600V for a 400 nm contact 44 as represented by line 150 in FIG. 12.

Thus contact height modification, beam thickness modification or the use of bumpers can be used singly or in any combination to modify the breakdown voltage, although the approach chosen may have an effect on other parameters of operation.

Figure 13:
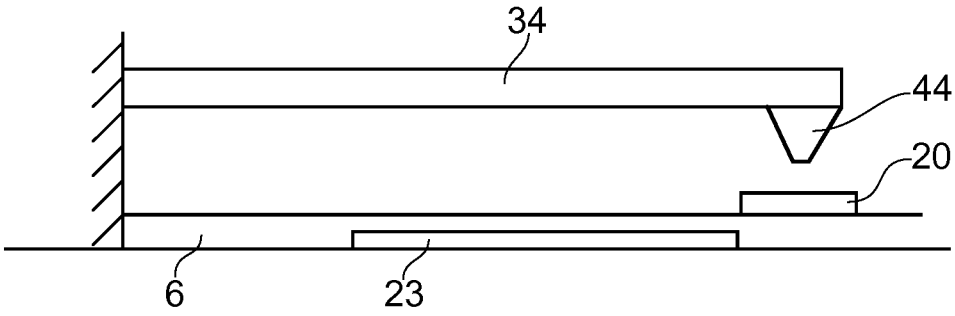
FIG. 13 is a cross section of a further embodiment of a MEMS switch.

A further approach to protecting the device from breakdown is to bury the gate such that it is covered by a thin dielectric, as shown in FIG. 13. Such an approach may increase the gate voltage required to close the switch, but it does allow the possibility of bringing the first switching contact closer to the gate to reduce the effect of trapped charge, so devices with a buried gate 23 may be more suitable for switches that are expected to be closed for a long time. The dielectric above the gate may be patterned to form apertures, trenches and so on in it to partially expose the gate electrode and to form a support structure that holds the switch member away from the gate.

In a further modification to the switch shown in FIG. 9 metal switch contacts isolated from the gate 23 may be positioned beneath the bumpers 120 and 124 and connected to the first switch electrode 20 such that excess flexing of the cantilevered switch member 32 adds additional current flow paths between the drain and source of the switch. Alternatively the contacts beneath the bumpers may be used to form a second switch contact.

In addition to, or as an alternative to, providing bumpers to inhibit the switch member 32 from touching the gate 23, the effective width of the switch member, or its thickness, may be modified to make the switch member 32 relatively stiff. Thus the switch member 32 may be relatively thick or relatively wide in the section that passes above the gate, but thinner or narrower elsewhere such that deflection is concentrated into a known region, such as that between the support 30 and an innermost bumper 124 (see FIG. 9).

A further feature which affects the ability to control the switch is temperature. This is predominantly caused by a mismatch in coefficients of thermal expansion, and the resultant forces that this creates.

Figure 14:
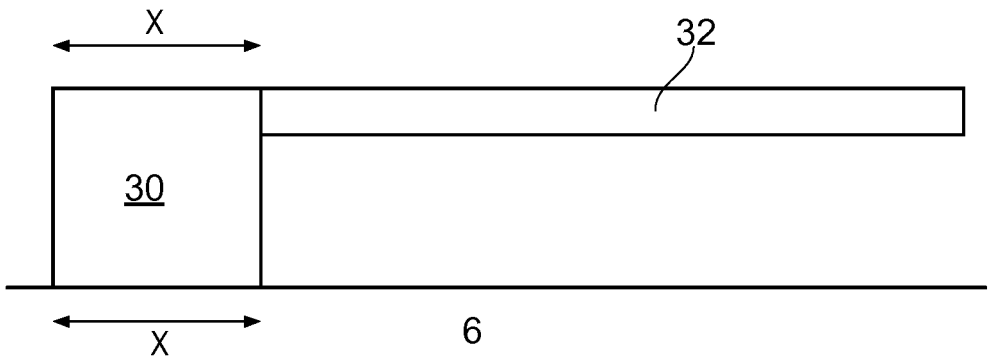
FIG. 14 is a schematic representation of a cantilever anchor at temperature T1.

FIG. 14 schematically illustrates a cantilevered switch contact 32 extending horizontally from the upper surface of a support 30 which for simplicity is assumed to have a side length of X at a first temperature $T_0$. As the temperature rises the support and the substrate expand.

If the substrate has a coefficient of expansion A and the support has a coefficient of expansion B, with B greater than A, then because the substrate holds and compresses the foot of the support 30, the support can be assumed to expand with the substrate at its foot, but to undergo substantially normal expansion at the top of the support. The coefficient of thermal expansion of gold is roughly five times greater than that of silicon, so an increase in temperature causes the walls of the support to diverge towards the top of the support, as shown in FIG. 15, in response to an increase in temperature.

Initially this can cause the switch to trigger close more easily. Indeed at around 250° C. the prior art switch becomes naturally closed. However over time this can cause the beam to become bent which in turn can cause the switch threshold voltage to change. It might be expected that the cantilevered switch member would not be exposed in use to such elevated temperatures. However, bonding of the cap 50 to the substrate by, for example using a glass frit may require process temperatures of around 440° C. Thus during manufacture thermal effects may be such that the beam is forced relatively strongly to the closed position, and at elevated temperatures where the beam may yield more easily. It is therefore beneficial to include features to prevent this from happening.

Figure 15:
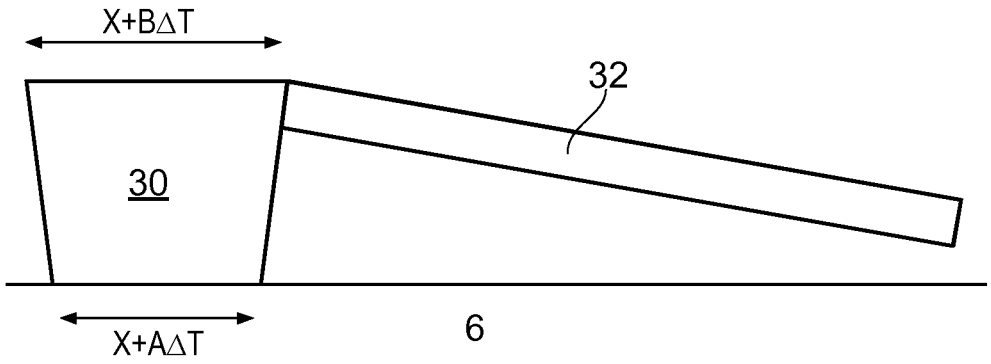
FIG. 15 shows the effects of thermal expansion on the arrangement of FIG. 14 following a temperature change of ΔT.

Expansion also occurs in the direction perpendicular to the plane of the page of FIGS. 14 and 15. Furthermore stresses can be trapped in the structure due to annealing of materials as they thermally cycle.

Similarly, reduction in temperature may cause the switch contact to deflect upwardly. These perturbations are undesirable.

The inventors have provided some structures that reduce the changes in the operating point of such a switch as a result of temperature.

A first approach involves modifying the amount of expansion occurring at the foot of the support. The foot of the support, or the materials around it may be modified to accommodate expansion more easily.

The coefficient of thermal expansion of gold is $7.9\times10^{-6}$ per degree. Silicon has a coefficient of $2.8\times10^{-6}$. Other metals such as Aluminum have coefficients of $13.1\times10^{-6}$ and Copper has a coefficient of $9.8\times10^{-6}$.

This difference in expansion coefficient between dissimilar materials can be used to counteract the displacement of the beam.

Figure 16:
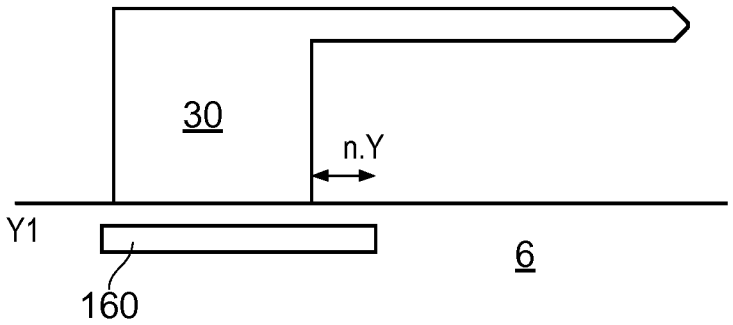
FIG. 16 shows an embodiment having an additional structure formed adjacent the foot of the support.

In a first structure, a metal plate can be provided near the foot of the support. A generally horizontal expansion modification structure 160, as shown in FIG. 16 may be provided. The structure 160 may be a layer of Aluminum or Copper whose purpose is to expand with increasing temperature so as to place a force on the substrate near the foot of the support 30 such that the foot can expand more than it would be allowed to if it were held solely by the silicon. As Aluminum and Copper both expand more than gold, whereas silicon does not, variations in the length, depth and thickness of the structure 160 with respect to the base of the foot allows the effective expansion coefficient of the silicon near the foot of the support to be more closely matched to that of the gold in the support 30.

Figure 17:
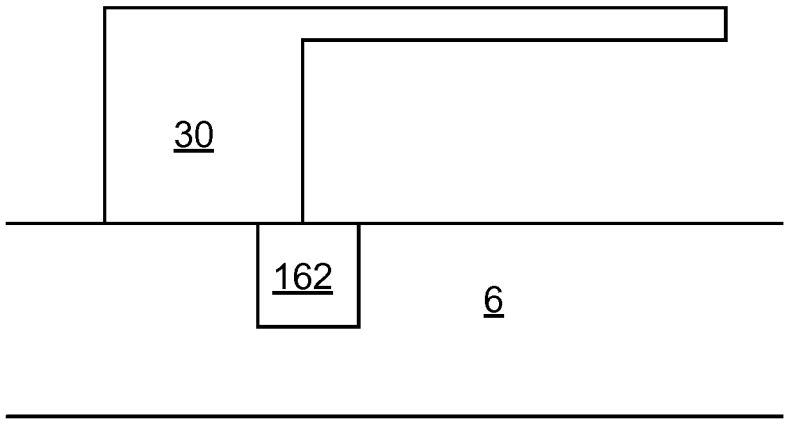
FIG. 17 shows a modification to the arrangement shown in FIG. 16.

In a further possibility an expansion modification structure 162 is formed so as to expand upwardly as the temperature rises, so as to act to rotate the support anticlockwise (as shown in FIG. 17) such that the wall section of the anchor at the top of the support remains substantially perpendicular to the plane of the substrate. These structures can be combined.

A way of reducing some of the stress is to modify the shape of the support. Recesses or slots may be formed in it to accommodate expansion.

Figure 18:
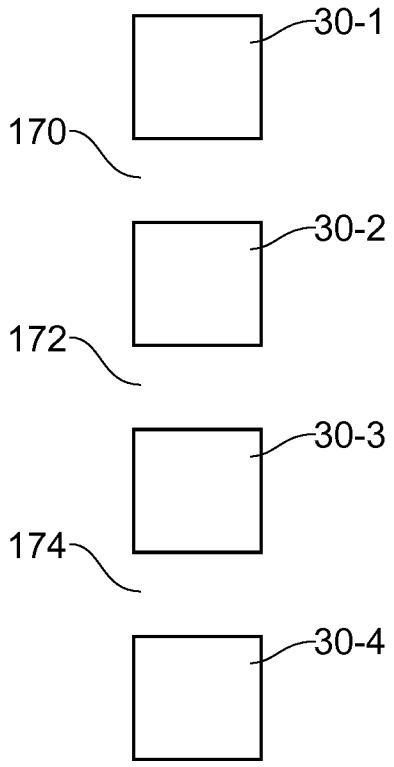
FIG. 18 is a plan view of a modified support.

In plan view the support may be sub-divided into a plurality of pillars 30-1 to 30-4 shown in FIG. 18 by slots 170, 172 and 174. This allows some of the compression at the foot of the support to be accommodated within the slots thereby acting to modify the shape at the top of the support to reduce the amount of distortion due to thermal expansion.

Similarly the switch member 34 may also be divided by slots into a plurality of individual fingers, extending from the support 30.

The approaches of removing material from the support 30 and its foot have the added financial advantage of reducing the amount of expensive gold used in the manufacture of the MEMS switch.

Figure 19:
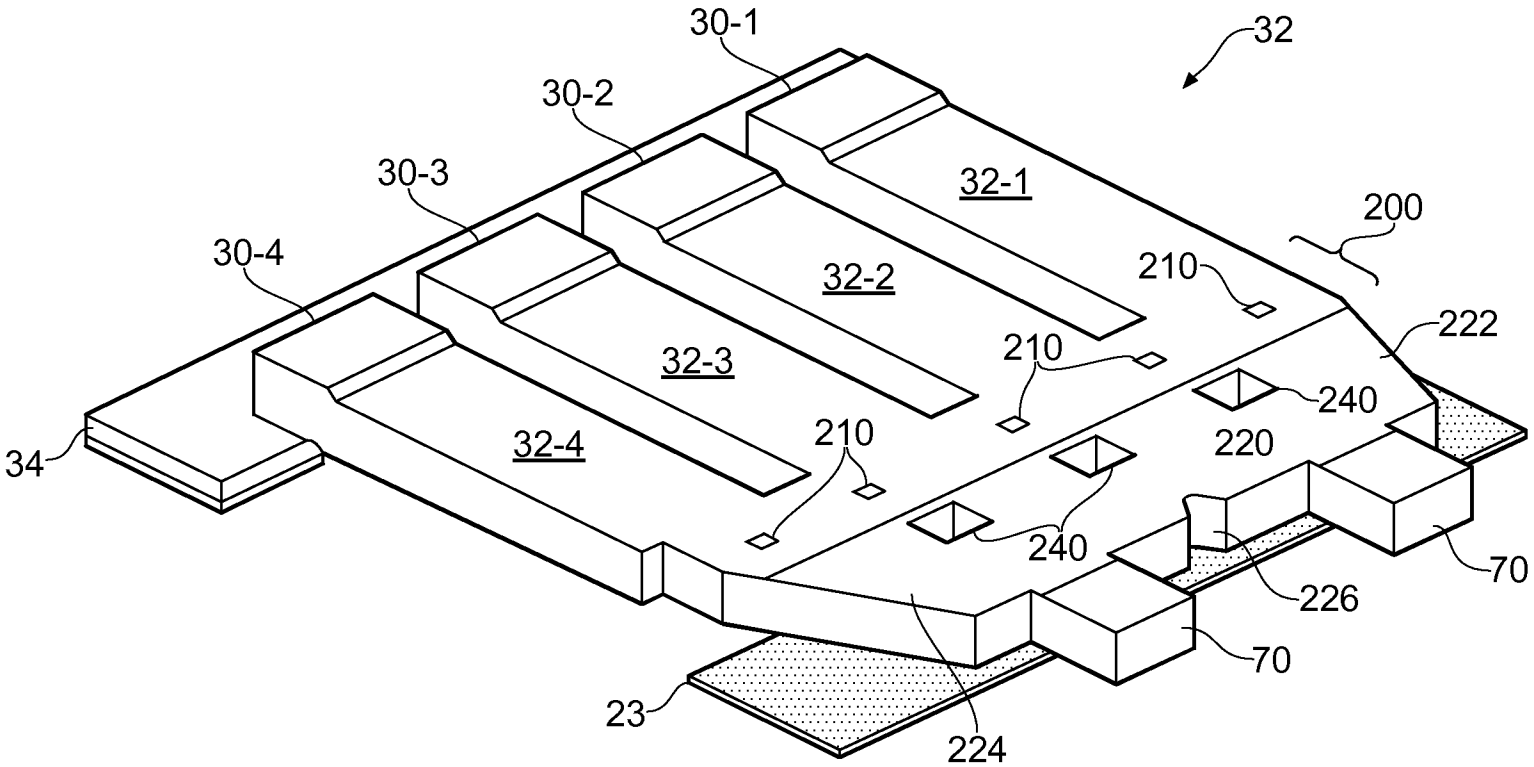
FIG. 19 is a perspective view of an embodiment of a MEMS switch.

A perspective representation of an embodiment of a MEMS switch is shown in FIG. 19. Here the foot region 34 is formed as a unitary element extending the width of the switch, but the support 30 is formed as four upstanding pillars 30-1 to 30-4 separated from one another by gaps. The switch member is divided into four sections 32-1 to 32-4 connected at one end to respective ones of the pillars 30-1 to 30-4 and joined together at a second end by a transverse region 200. The region carries depending bumper pads, the positions of which are schematically denoted by squares 210.

An end portion 220 of the switch member 32 has generally tapered regions 222 and 224 which allow the end of the structure to be shielded from trapped charge by the gate electrode 23.

Additionally the gate electrode 23 is relatively thin and placed under the end portion 222 and near the depending contacts (not shown) carried by the contact carriers 70. This means that no electrostatic force is applied beneath regions 32-1 to 32-4 reducing the risk of these regions touching the substrate.

Typically the switch member 32 is around 70 to 110 μm long although other lengths may be used, and it may have a comparable width.

The gap from the end of the depending switch contact 44 (FIG. 1) to the first switch electrode 20 (not shown in FIG. 19 for clarity but shown in FIG. 1) is around 300 nm and the contact length is around 200 nm to 400 nm. Consequently the gap beneath the switch member 32 to the substrate 6 is around 0.6 μm.

During manufacture a sacrificial layer is formed over the substrate in the region that will, in the finished device, be the gap. Then the metal, generally but not necessarily gold, of the switch member is deposited over the sacrificial layer and the sacrificial layer is etched away to release the switch member to form the cantilevered structure shown in FIGS. 1 and 19. This process is known to the person skilled in the art.

However, in order to increase yield and have switches that will close, it is necessary to remove the sacrificial material in a reliable and economic manner.

The formation of the slots in between the regions 32-1 to 32-4 of the switch member 32 facilitates the etchant reaching the sacrificial layer beneath the switch member. Similarly the tapering in regions 222 and 224, and to some extent in a region 226 between the contact carriers 70 also facilitates the removal of the sacrificial material. However this could still leave substantial areas beneath the region 220 where there was a significant distance for the etchant to travel. In order to facilitate reliable release etch apertures 240 are provided in the region 220, the apertures extending though the switch member 32 such that etchant can more easily penetrate the space between the substrate and the switch member 32 and remove the sacrificial material.

A greater or fewer number of etch apertures may be provided. Etch apertures may be provided in a two dimensional pattern. Patterns may be regular, such as square or hexagonal patterns, or may be randomized.

The length of the slots between the arms 32-1 to 32-4 may be varied, and etch apertures may be provided closer to the support 30. This can give rise to an etch distance from an edge or aperture of around 15 microns, although distances between 8 and 20 microns are contemplated.

The switches may have one contact, two contacts, as shown in FIG. 19, or more contacts. The use of multiple contact provides for a lower on state resistance. In some embodiments switches have 3, 4, 5 or more contacts.

The various features described herein can be used in combination. These embodiments may include supports divided into blocks and columns as shown in FIGS. 18 and 19, with or without the use of bump pads or other additional supports, with or without tapered hinges, chamfers or notches, with or without an extended gate to reduce overdrive, with or without the gate being positioned nearer the depending contact to reduce overdrive stress, with or without elongated depending contacts to increase breakdown performance, with or without inserts adjacent the foot of the support to reduce thermal stress and consequent movement of the switch member, and with or without use of enhanced thickness of the switch member.

In further variations, sacrificial material might be formed beneath part of the foot 34 or part of the first switch contact, and then etched away to reduce thermal stresses. Such options are schematically illustrated in FIG. 20.

Figure 20:
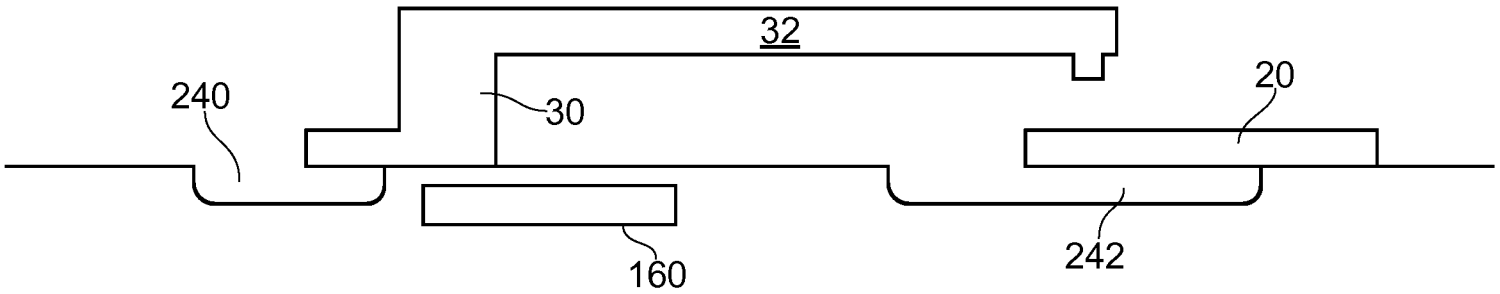
FIG. 20 is a cross sectional view of further features that may be added to a switch.

In FIG. 20, part of the substrate behind the anchor 30 has been etched away, for example in trenches 240 aligned with the columns 30-1 to 30-4 of FIG. 18 so as to reduce the compression occurring at the foot of the columns 30-1 to 30-4. This allows the foot to expand more easily and reduces the thermally induced inclination at the top of the support. This can be in place of or in addition to use of a buried metal insert 160 in the substrate to force the substrate to expand with an effective coefficient of thermal expansion more closely matched to that of the metal used to form the support.

Similarly the first contact 20 may be extended and partially under etched to form a cavity 242 and a cantilevered contact extending over the cavity. Thus the first contact 20 can deflect under load from the switch member 32 reducing the maximum stress experienced by the switch member 32. This also allows the distance from the substrate to the switch member 32 to be increased in the region of the cavity 242 by the depth of the cavity, reducing the attractive force of trapped charge.

Figure 21:
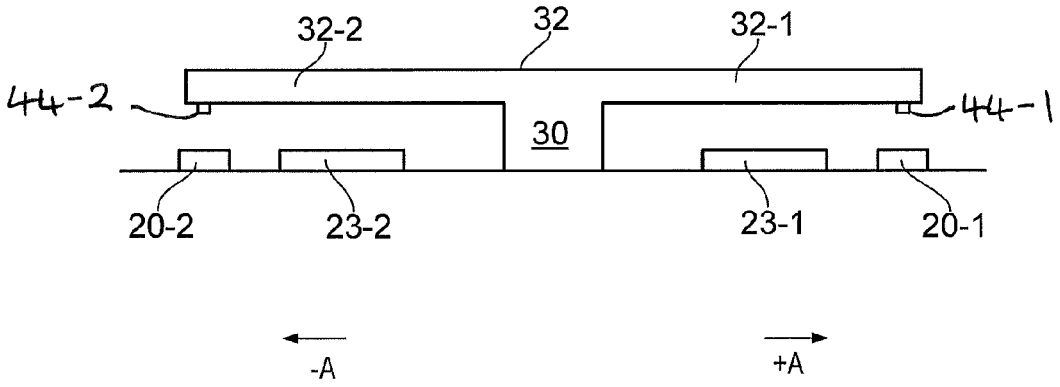
FIG. 21 is a cross section of a switch that has two gates so it can be driven closed and driven open.

In further embodiments, the cantilever can be extended either side of the support as shown in FIG. 21. Thus a first portion 32-1 of the switch member 32 may extend away from the support 30 in the first direction A, and a second portion 32-2 of the switch member 32 may extend away from the support 30 in a third direction, -A and carry a second switch contact 44-2. The switch may be formed with two gates 23-1 and 23-2 independently driven to allow one side or the other of the switch to be driven to a closed position. If two source contacts are provided, as shown as items 20-1 and 20-2 then a single throw two pole switch operable in a break before make manner is provided.

One of the sources, for example 20-2 may be left unused or be omitted to form a switch where once the gate voltage on gate 23-1 has been removed so as to allow the switch to open, gate 23-2 may be energized to pull the left hand side (as shown in FIG. 21) towards the substrate so as to ensure that the switch opens.

In such an actively driven switch the switch member beam needs to be sufficiently stiff to avoid excessive flexing that leads to overdrive breakdown, but the support and/or hinges can be made much thinner as it or they does not need to provide so much of the restoring force. The support now serves to hold the switch member away from the substrate. Use of a reduced thickness support reduces the differential expansion from top to bottom and consequently reduces the tendency for the switch gap to close with increased temperature. Furthermore since in a single pole switch the left hand side (as shown) used for opening the switch does not need to conduct it can be made of a different metal and need not incur the expense of using gold. Similarly with a reduced support thickness and the possibility of using shorter arms the amount of gold may be reduced.

In the embodiments described thus far, the switch member 32 has provided a conductive path between the support 30 and the first switch contact 20. As a result the need to have a controllable and reasonable threshold voltage has been balanced against having the switch member collapse onto the gate electrode.

Figure 22:
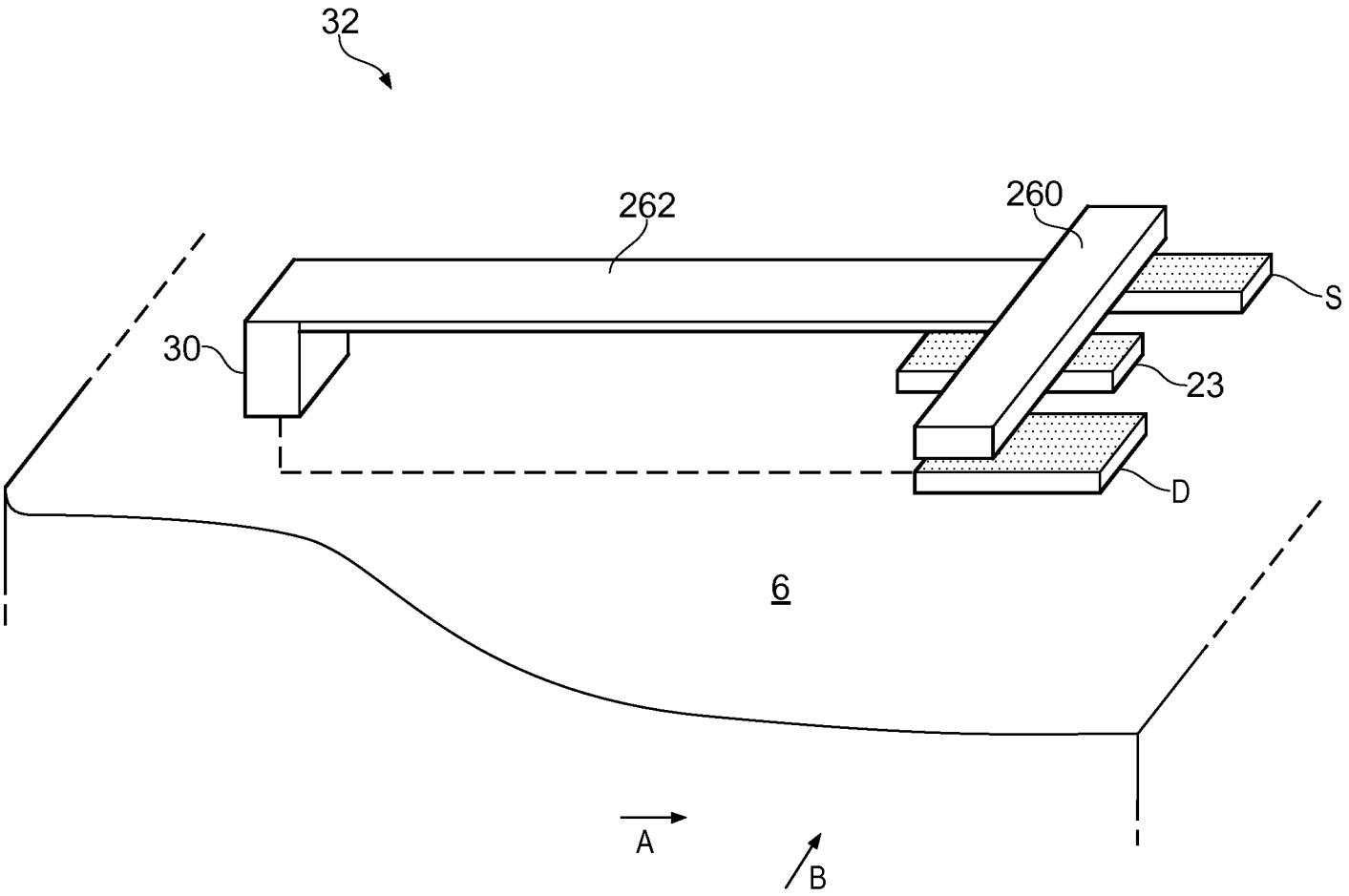
FIG. 22 is a perspective representation of a further embodiment of a MEMS switch.

In a further variation, an example of which is shown in FIG. 22, the switch member 32 can be notionally divided into a conduction element 260 and a restoring spring 262. Here, for diagrammatic simplicity the conduction element 260 has been drawn as a bar mounted transversely at a free end of the restoring spring 262. The restoring spring 262 is shown as forming a cantilever from the support 30 as has hitherto been described in respect of the switch member 32. However, now the support 30 and spring 262 need not form part of the conduction path through the device. Instead first and second switch contacts are formed beneath opposing ends of the conduction element to form the sources and drains of the switch.

The gate 23 may be formed between the source and drain. The gate may be thinner than the source and drains S and D, and/or the conduction element may have depending contacts (as described with respect to contact 44) to hold the center of the conduction element 260 above and spaced apart from the gate when the switch is closed.

The mechanical properties of the conduction element and of the spring are now decoupled, and each of the conduction element 260 and the spring 262 can be specified for their individual roles. Thus the spring can be relatively long and relatively thin to give a low threshold voltage. The conduction element 260 can be short and thick to avoid it deforming and touching the gate.

The materials used in each element do not have to be the same, and hence the amount of expensive gold can be reduced by forming the spring out of another material. Furthermore, since the conduction element can be made wider, i.e. to extend further in the first direction A, and thicker, as well as shorter in the second direction B, then the conduction element 260 may be made from other materials, such as copper or aluminium which may be selected for reduced cost, or rhodium which may be selected for its hard wearing mechanical properties. Other materials may be selected to help withstand possible arcing that might occur of the switch is operated with a non-zero, or significantly non-zero, drain to source voltage.

Since the spring 262 is no longer required to conduct electricity it need not be formed out of metal, and the support 30 and the restoring spring 262 may be formed from the same material as the substrate, e.g. silicon. This removes or reduces the thermal expansion issues discussed hereinbefore. The spring and the conduction element may be galvanically isolated from each other.

Figure 23:
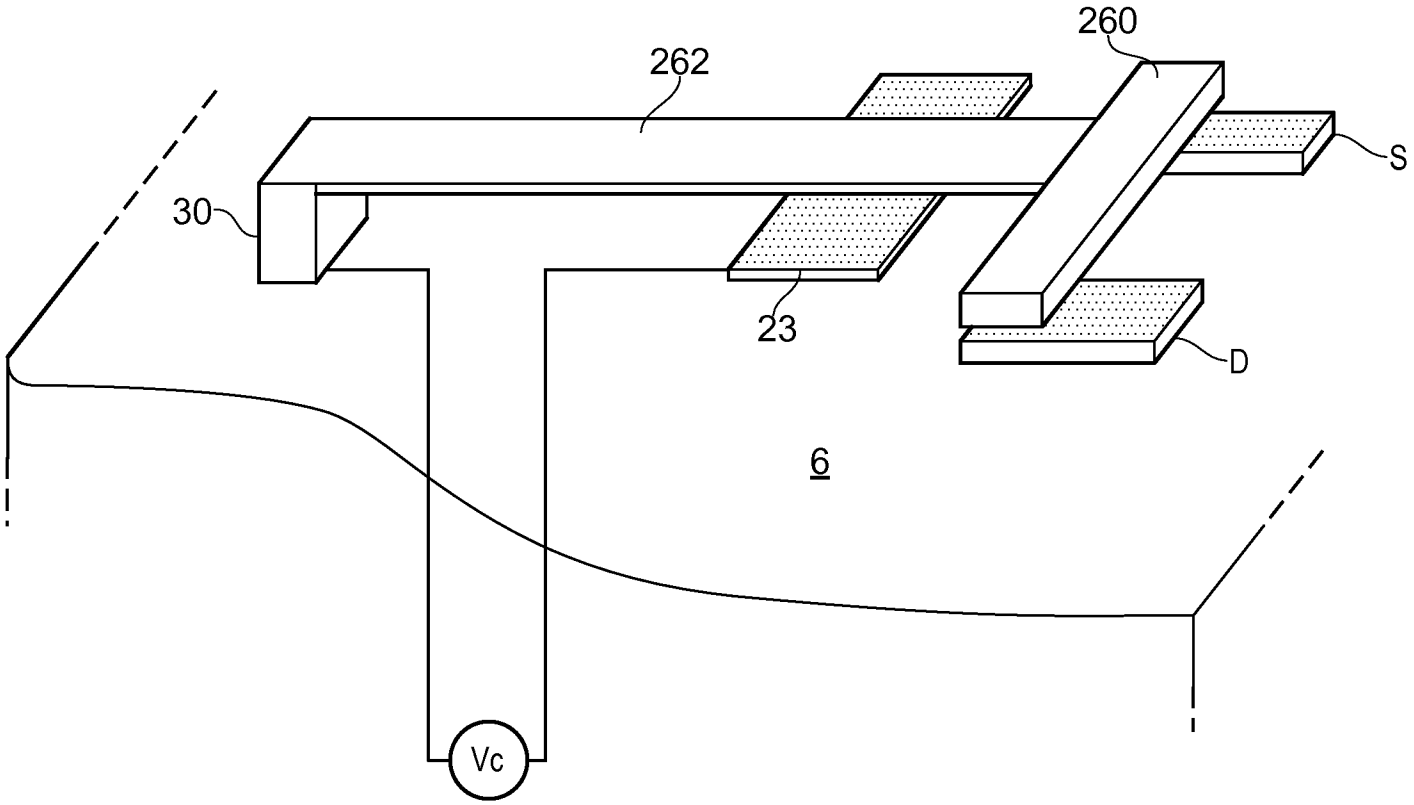
FIG. 23 shows a variation to the arrangement shown in FIG. 22.

The gate 23 need not be positioned between the source and drain as indicated, and instead could be positioned beneath the spring 262. In order to establish a potential difference between the gate and the spring 262 or the conduction member 32, the support 30 and spring 262 need to be conductive, but may have a high resistance, and the support needs to be connected to the drain, the source, or a local ground. An example of such a variation in gate position and electrical connection is shown in FIG. 23.

The conduction element 260 does not have to be formed transversely to the spring. It may be a rectangular or other shaped element formed in line with the spring 262.

Similarly the conduction element 260 need not be rectangular in shape, and need not be supported by a single elongate spring. Springs 262 may be serpentine, spiral or zigzag, or any other suitable shape.

Although embodiments have been described with a cantilever, making the switch member an elongate object, other designs utilizing three dimensional space more fully may be used. Non-cantilevered embodiments of MEMS switches are shown in FIGS. 24 to 26.

Figure 24:
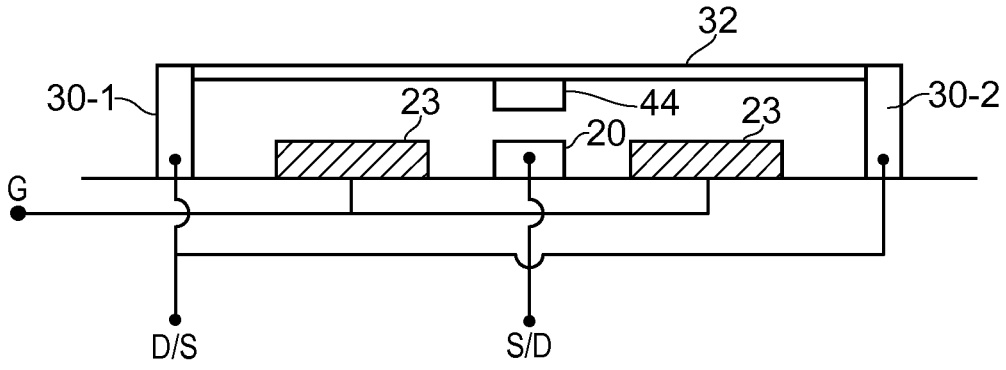
FIG. 24 is a schematic cross section through an embodiment where the beam is supported at two places.

In FIG. 24 two supports, designated 30-1 and 30-2 are provided and the switch member 32 extends between them. In this arrangement the first switch contact 20 is disposed between the gate electrodes 23 and is aligned with the depending contact 44. The supports 30-1 and 30-2 can be the drain or source, and the switch contact 20 can be the source or the drain.

The arrangement shown in FIG. 24 can be formed in a linear fashion as shown or can be formed with rotational symmetry such that the gate 23 forms a ring of metal that encircles the contact 20.

Figure 25:
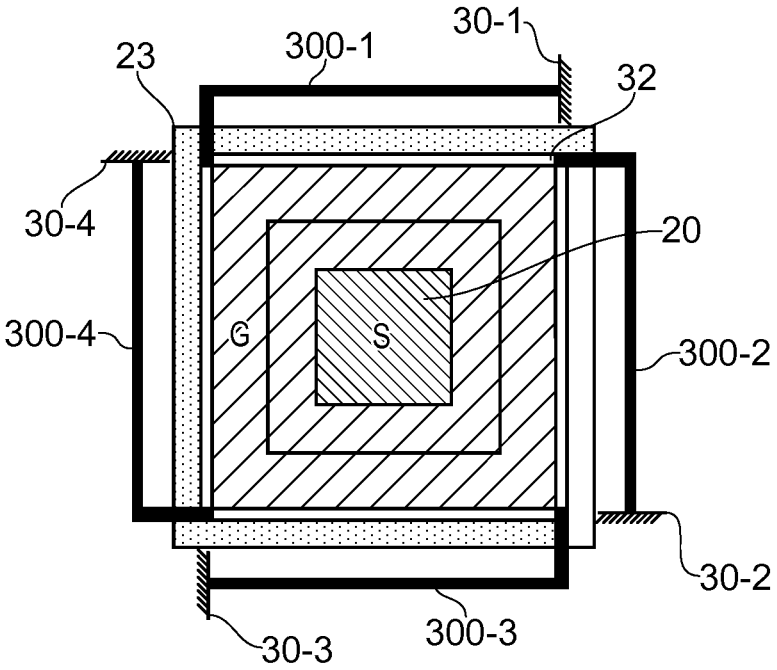
FIG. 25 is a schematic plan view of a further embodiment of a MEMS switch.
Figure 26:
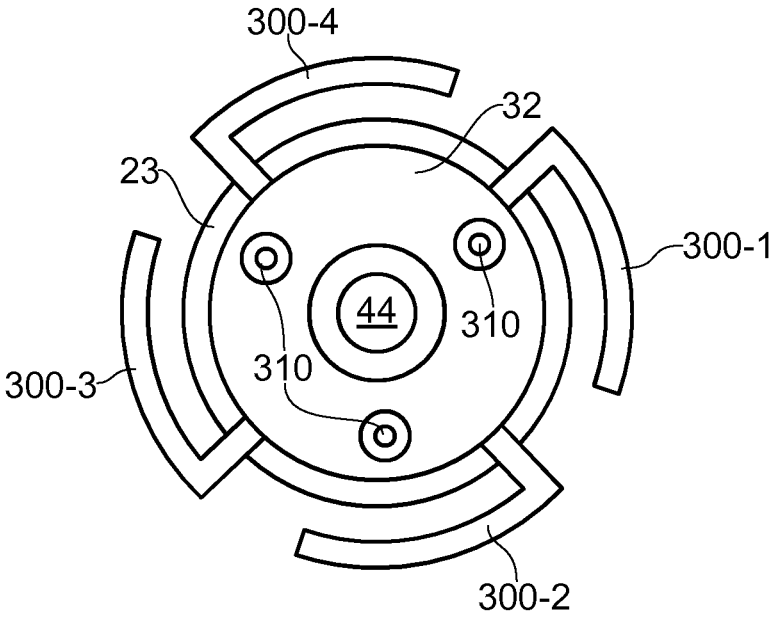
FIG. 26 is a schematic plan view of a further embodiment.

FIG. 25 shows a variation where a rectangular or square switch member 32 is supported by a plurality of supports 30-1 to 30-4 and intermediate arms 300-1 to 300-4. The switch member 32 is suspended over a gate 23 which has an aperture in the middle thereof in which the first switch contact 20 is formed. FIG. 25 is drawn so as to illustrate the position of the gate 23 and the contact 20 that lie beneath the switch member 23.

FIG. 26 shows a variation in which the switch member is substantially circular and connected to supports by a plurality of arms 300-1 to 300-4. Although in FIGS. 25 and 26 fours arms have been shown, fewer (2 or 3) or more arms, or other shapes of intermediate support structures may be used. The switch member 32 is a solid element which may have one or more supports 310 depending from its surface facing the substrate as well as one or more switch contacts. The switch member 32 is suspended over a gate which has apertures formed therein as described hereinbefore to facilitate use of the supports and to allow the first switch contact (and possibly further switch contacts) to be formed.

The use of a "teeter-totter" or see-saw design as previously discussed with respect to FIG. 21 can be used with the designs of FIGS. 22 and 23 where the conducting element 260 is carried on the end of an arm, which may act with the support to provide some of the restoring force. It is desirable that it provides sufficient restoring force to leave the switch member in a known position (such as to leave the switch open) when the switch is depowered.

However, the designer has freedom of choice over the relative positions of the first and second gates 23-1 and 23-2 with respect to the support, and also freedom of choice over the voltages applied to them to close and open the switch.

Figure 27:
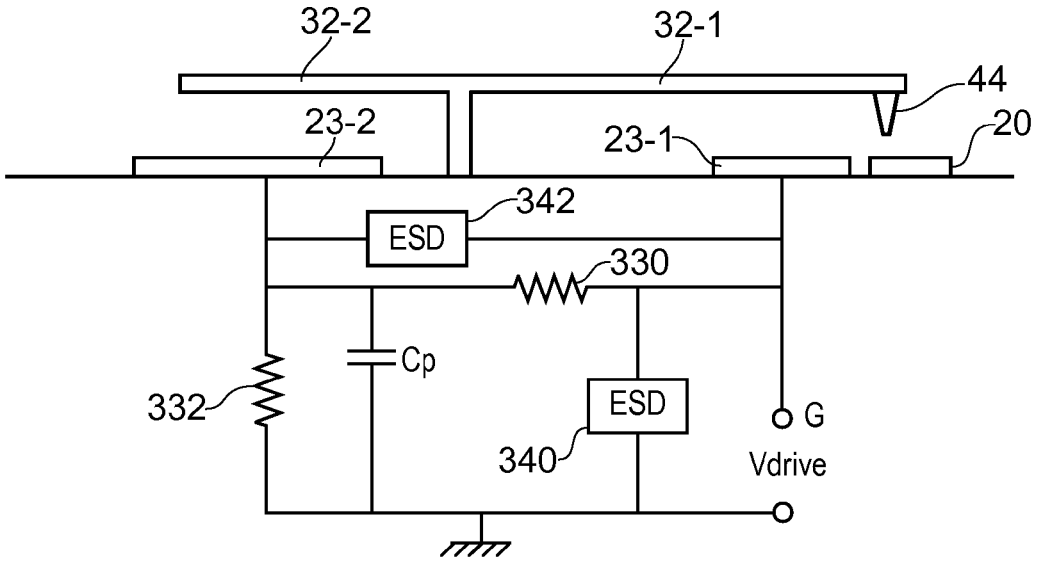
FIG. 27 shows a schematic view of an asymmetric beam design, and also shows a version of a drive scheme for teeter-totter switches.

In the arrangement shown in FIG. 27 the first portion 32-1 of the switch member has been selected to be longer than the second portion 32-2 of the switch member. This, in conjunction with tapering, and so on, allows the closing force (and hence voltage required) and yield of the switch member to be controlled as described hereinbefore. Similarly, if the design of FIG. 23 is used to form the conduction element, then the materials used to form the first portion 32-1 and the support 30 can be primarily chosen for their mechanical rather than electrical properties.

The second portion 32-2 in conjunction with the second gate 23-2 only needs to provide sufficient restoring force to ensure the switch opens correctly when the drive voltage to the first gate is removed. Thus the second portion can be shorter than the first portion, thereby reducing the footprint of the switch compared to having first and second portions the same length.

The first and second gates may be driven independently, for example by inverted versions of the drive signal. Alternatively the single drive signal may be used to provide both the switch on (closing) force and the switch off (opening) force. Such a drive scheme is also shown in FIG. 27.

The switch receives a drive signal Vdrive at its "gate" terminal G. The first gate 23-1 is connected to the "gate" G by a low impedance path. The second gate 23-2 is connected to the gate G by a high impedance path, represented by resistor 330. Thus, given that the second gate 23-2 will be associated with a parasitic capacitance, represented as Cp in FIG. 27, the voltage at the second gate will rise slowly compared to the near instantaneous change in gate voltage at the first gate 23-1 when the drive signal is applied. This change in voltage is determined by the RC time constant of resistor 330 and capacitor Cp. Therefore the second gate does not apply any restoring force during an initial closing phase of the switch. As the second gate 23-2 starts to become charged, it begins to exert an opening force. The designer needs to control the relative sizes of the force from the second gate to that from the first gate to ensure that the combined restoring forces do not open the switch or reduce the contact force too much. This can be achieved by placing the second gate 23-2 closer to the support (as shown) modifying the area of the second gate, or restricting the voltage at the second gate. In the example shown in FIG. 27, the voltage at the second gate 23-2 is controlled to be a known fraction of the voltage at the first gate (under steady state conditions) by connecting the second gate 23-2 to a local ground through a second resistor 332 such that the resistors form a potential divider.

When the drive voltage is removed, the potential of the first gate 23-1 reduces very quickly whereas the potential at the second gate decays away more slowly. Thus for a while the second gate is at a higher voltage than the first gate, and this opening force acts to lift the switch contact 44 away from the contact 20.

It is advantageous for the switch not to close unexpectedly in response to a voltage transient as a result of, for example, electrostatic discharge (ESD) or operation of an inductive local. The teeter-totter designs can be modified to provide good immunity to ESD or overvoltage events as the ESD event may effect both gates at the same time. Protection cells 340 and 342 may be provided that are normally high impedance when the voltage across them reaches a predetermined value. Such cells 340 and 342 are known to the person skilled in the art so need not be described in detail here.

A first cell 340 may be provided to limit the voltage at the first gate 23-1 in response to an overvoltage or ESD event. Additionally or alternatively a second protection cell 342 may be provided to interconnect the first and second gates in response to an ESD event such that a relatively large restoring force is applied to counter the closing force by the ESD event at the first gate.

Instead of deriving the second gate voltage from the control signal, the second gate may be pre-charged or driven from a separate gate control signal. Use of an electrically controlled opening force provides greater flexibility than relying solely on a mechanical opening force, and enables the forces to be tuned or changed in use, or during testing, to accommodate process variations.

Figure 28:
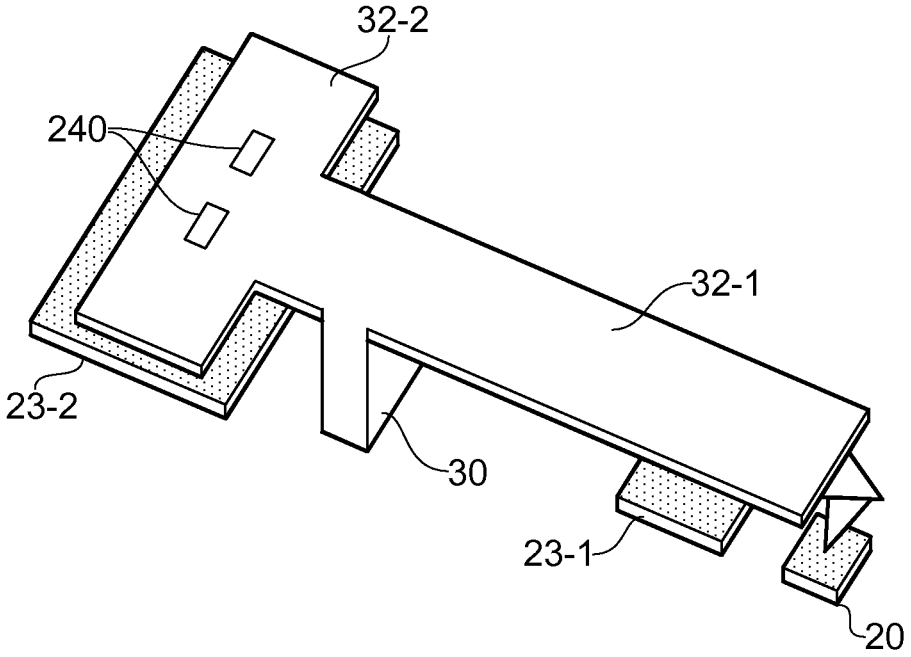
FIG. 28 shows a perspective view of a further asymmetric teeter-totter switch.

The relative widths of the first and second portions 32-1 and 32-2 can be varied, as shown in FIG. 28, to modify the relative magnitudes of the opening and closing forces. Similarly the gate sizes can be modified.

Figure 29:
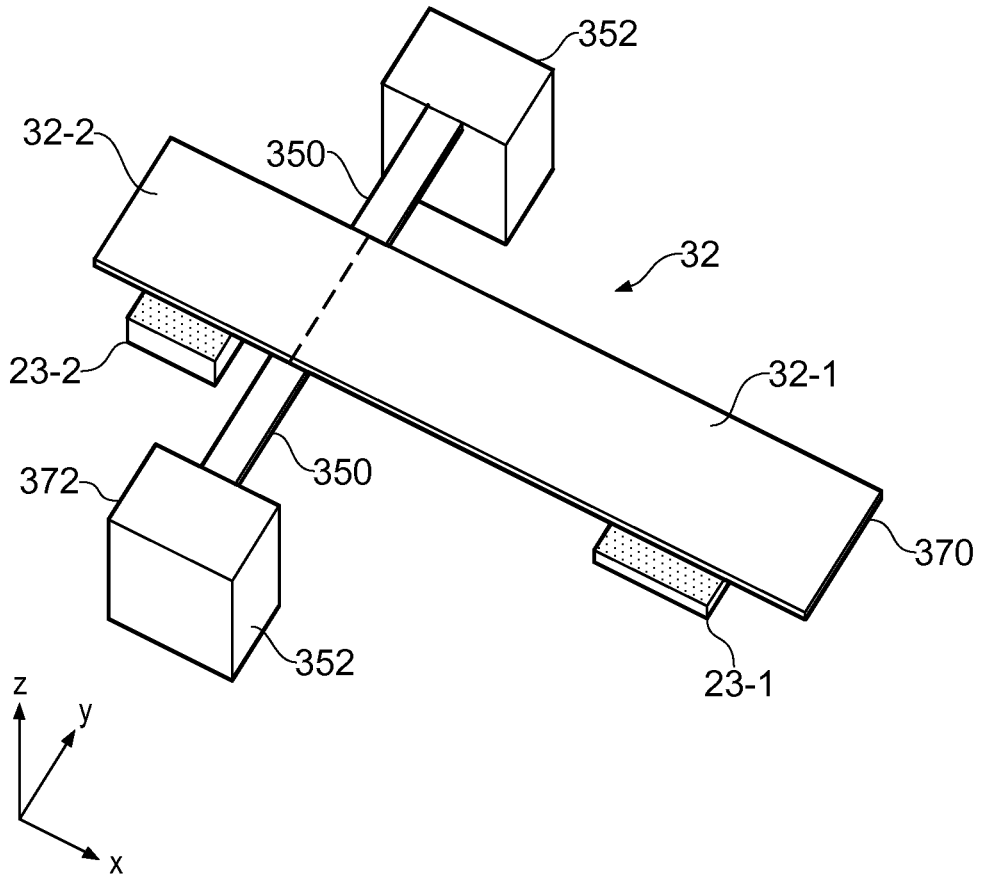
FIG. 29 shows an embodiment having torsional supports.

In a further variation that can be applied to cantilever or teeter-totter (see-saw) switch or MEMS components, the upstanding support 30 may be replaced with a torsional support as shown in FIG. 29. In FIG. 29 the switch member 32 is shown as being part of a teeter-totter design, and hence is divided into portions 32-1 and 23-2. However, the principles discussed here also apply to cantilever designs.

The support structure now comprises one or more, and for simplicity two, laterally extending arms 350 which extend from the switch member 32 to supports 352. The arms 350 each have a width in the X direction, a length in the Y direction and a thickness in the Z direction. Each arm is naturally planar, and tends to resist twisting around its Y direction. The restoring force increases with width X, and with thickness Z, and decreases with length Y. Thus the designer has a significant amount of freedom to control the torsional force seeking to return the beam 32 to its rest position. Furthermore, by appropriate positioning on the arms 350 with respect to the supports 352, the differential thermal expansion between the top and bottom of the support can be nullified or exploited. Thus, if the arms 350 are centrally disposed along the support 352 then the end portion 270 tends not to move up or down in response to temperature change. If the arms 350 are moved towards the edge 372 of the supports 352, then excess temperature (as might be experienced during some manufacturing steps) tends to cause the end portion 370 to lift away from the underlying substrate.

The arrangement shown in 27 is suited for use with a separate contact portion 260*c*, described with respect to FIGS. 22 and 23.

It is thus possible to provide an improved MEMS switch.

Although single dependency claims have been presented for filing at the USPTO it is to be understood that claims can be provided in any combination that results in a technically feasible device.

What is claimed is:

1. A MEMS component, comprising:

a substrate having a first coefficient of thermal expansion;

a support extending from the substrate, and having a second coefficient of thermal expansion;

the MEMS component further comprising an expansion modification structure at or adjacent an interface between the substrate and the support, and having a third coefficient of expansion greater than the first coefficient of expansion, and arranged to exert a thermal expansion force on the substrate in the vicinity of the interface so as to simulate a fourth coefficient of expansion different from the first coefficient in the substrate in the vicinity of the interface, and further comprising a recess or channel formed adjacent an edge of the foot of the support to reduce thermal stress exerted between the substrate and the support.

2. A MEMS switch, wherein the switch includes structures to reduce the tendency of the switch to close as a result of increases in temperature, the MEMS switch comprising:

a substrate upon which components of the switch are carried, the substrate having a first coefficient of thermal expansion;

a support extending from the substrate and carrying a movable switch contact, the support being formed of a different material than the substrate and having a second coefficient of thermal expansion;

the MEMS switch further comprising a block or plate of material within the substrate beneath a foot of the support and having a third coefficient of thermal expansion greater than the expansion coefficient of the substrate, and arranged to exert a thermal expansion force on the substrate in the vicinity of the base of the support so as cause substrate near the support to behave as if it had a coefficient of thermal expansion more like that of the material of the support.

3. A MEMS component, comprising:

a substrate;

a support;

a movable structure including a contact carrier portion;

a control electrode; and a first switch contact wherein the support extends from the substrate and holds a portion of the movable structure adjacent the substrate; the movable structure extends in a first direction from the support towards the first switch contact such that the contact carrier portion extends over at least part of the first switch contact the movable structure overlaps with the control electrode; a second portion of the movable structure extends in a third direction from the support, the third direction being substantially opposed to the first direction, and where the second portion overlaps with a second control electrode and in which a spatial extent of the control electrode in a second direction perpendicular to the first direction is greater than the spatial extent of the movable structure in the second direction such that the control electrode extends beyond opposing sides of the movable structure in the second direction; and in which the second control electrode is configured to be selectively connected to a voltage in order to attract the second portion of the movable structure and thereby to urge the movable structure away from engagement with the first switch contact and in which the first control electrode and the second electrode are connected to a shared control node, and where the voltage for the second control electrode is derived by a low pass filter connected to the shared control node and comprising a resistance in series with a capacitance, and the second control electrode is connected to a node between the resistance and the capacitance.

4. A MEMS electrical switch comprising:

a substrate;

a support; and a switch member supported by the support at a position such that a portion of the switch member extends away from the support in a first direction towards a first switch contact and over a first control electrode; wherein when the switch is closed, the switch member is in contact with the first switch contact and the MEMS switch further comprises a second control electrode adjacent a portion of the switch member such that an attractive force acting between the second control electrode and the switch member urges the switch member to move away from the first switch contact, and in which the second control electrode is connected to the first control electrode via an electrostatic protection or overvoltage protection device, and in which the second control electrode is connected to the first control electrode by a high impedance path such that a voltage at the second control electrode lags a voltage of the first control electrode and in which the voltage at the second control electrode tends to a fraction of the voltage at the first control electrode as set by a potential divider.

5. A MEMS electrical switch comprising:

a substrate;

a support; and a switch member supported by the support at a position such that a portion of the switch member extends away from the support in a first direction towards a first switch contact and over a first control electrode; wherein when the switch is closed, the switch member is in contact with the first switch contact and the MEMS switch further comprises a second control electrode adjacent a portion of the switch member such that an attractive force acting between the second control electrode and the switch member urges the switch member to move away from the first switch contact, and in which the second control electrode is connected to the first control electrode via an electrostatic protection or overvoltage protection device, and in which the first control electrode and the second electrode are connected to a shared control node, and where the voltage for the second control electrode is derived by a low pass filter connected to the shared control node and comprising a resistance in series with a capacitance, and the second control electrode is connected to a node between the resistance and the capacitance.

6. A MEMS switch comprising:

a substrate:

a support;

a movable structure;

a control electrode;

arranged such that the movable structure is held by the support above the substrate and extends over the control electrode, and wherein the movable structure has at least one depending bumper formed thereon arranged not to touch the control electrode, where the depending bumper holds the movable structure spaced apart from the control electrode during use, and wherein the depending bumper is formed on the movable structure in a region overlapping the control electrode, and the control electrode includes an aperture in a corresponding portion of the control electrode.

7. A MEMS switch as claimed in claim 6 further comprising an insulator between the control electrode and the movable structure.

8. A MEMS electrical switch comprising:

a substrate;

a support; and a switch member supported by the support at a position such that a portion of the switch member extends away from the support in a first direction towards a first switch contact and over a first control electrode; wherein when the switch is closed, the switch member is in contact with the first switch contact and the MEMS switch further comprises a second control electrode adjacent a portion of the switch member such that an attractive force acting between the second control electrode and the switch member urges the switch member to move away from the first switch contact, and in which the second control electrode is connected to the first control electrode by a high impedance path such that a voltage at the second control electrode lags a voltage of the first control electrode.

9. A MEMS electrical switch as claimed in claim 8 in which the voltage at the second control electrode tends to a fraction of the voltage at the first control electrode as set by a potential divider.

10. A MEMS switch, comprising:

a substrate;

a support;

a movable structure;

a control electrode;

arranged such that the movable structure is held by the support above the substrate and extends over the control electrode, and wherein the movable structure has at least one structure formed thereon to hold the movable structure spaced apart from the control electrode during use, and wherein the movable structure includes a depending bumper arranged not to touch the control electrode.

11. A MEMS switch as claimed in claim 10 in which the depending bumper is formed to one side of the control electrode.

12. A MEMS switch as claimed in claim 10 further comprising an insulator between the control electrode and the movable structure.

13. A MEMS component, comprising:

a substrate having a first coefficient of thermal expansion;

a support extending from the substrate, and having a second coefficient of thermal expansion;

the MEMS component further comprising an expansion modification structure at or adjacent an interface between the substrate and the support, and having a third coefficient of expansion greater than the first coefficient of expansion, and arranged to exert a thermal expansion force on the substrate in the vicinity of the interface so as to simulate a fourth coefficient of expansion different from the first coefficient in the substrate in the vicinity of the interface, and in which the support has at least one slot formed therein to divide the support into a plurality of upstanding elements.

14. A MEMS component as claimed in claim 13 in which the at least one slot extends through the support dividing it into a plurality of pillars.

15. A MEMS component as claimed in claim 13 in which the switch member is slotted along a portion of its length.

16. A MEMS switch as claimed in claim 13 further including a first switch contact having a region thereof configured as a cantilever or beam over a void such that the first switch contact is configured to deflect in response to pressure exerted on it by the switch member.

17. A MEMS component, comprising:

a substrate having a first coefficient of thermal expansion;

a support extending from the substrate, and having a second coefficient of thermal expansion;

the MEMS component further comprising an expansion modification structure at or adjacent an interface between the substrate and the support, and having a third coefficient of expansion greater than the first coefficient of expansion, and arranged to exert a thermal expansion force on the substrate in the vicinity of the interface so as to simulate a fourth coefficient of expansion different from the first coefficient in the substrate in the vicinity of the interface, and in which the expansion modification structure comprises a plate or block like structure buried beneath a foot of the support.

18. A MEMS component as claimed in claim 17 in which the third coefficient of thermal expansion is greater than the second coefficient of thermal expansion.

19. A MEMS component as claimed in claim 17 in which the expansion modification structure is separated from the support by a portion of the substrate.

20. A MEMS component as claimed in claim 17 in which the expansion modification structure extends beyond an edge of the support.

21. A MEMS component as claimed in claim 17 in which the expansion modification structure is formed of Aluminum or Copper.

22. A MEMS component as claimed in claim 17 in which the MEMS component is a switch and a switch member is supported by the support.

23. A MEMS component as claimed in claim 17 further comprising a recess or channel formed adjacent an edge of a foot of the support to reduce thermal stress exerted between the substrate and the support.

24. A MEMS switch comprising:

a substrate;

a support;

a switch member supported by the support at a position such that a portion of the switch member extends away from the support in a first direction towards a first switch contact and over a first control electrode;

wherein the MEMS switch further comprises a second control electrode adjacent a portion of the switch member such that an attractive force acting between the second control electrode and the switch member urges the switch member to move away from the first switch contact, in which the second control electrode is connected to the first control electrode by a high impedance path such that a voltage at the second control electrode lags a voltage of the first control electrode.

25. A MEMS switch as claimed in claim 24 in which the voltage at the second control electrode tends to a fraction of the voltage at the first control electrode as set by a potential divider.

26. A MEMS switch as claimed in claim 24 in which the first control electrode and the second control electrode are connected to a shared control node, and where the voltage for the second control electrode is derived by a low pass filter connected to the shared control node and comprising a resistance in series with a capacitance, and the second control electrode is connected to a node between the resistance and the capacitance.

27. A MEMS switch as claimed in claim 26 in which a second resistance is connected in parallel with the capacitance such that the voltage stored on the capacitance and supplied to the second control electrode is smaller in magnitude than a voltage supplied to the first electrode to close the switch.

28. A MEMS component, comprising:

a substrate;

a support;

a movable structure including a contact carrier portion;

a control electrode; and a first switch contact;

wherein the support extends from the substrate and holds a portion of the movable structure adjacent the substrate; the movable structure extends in a first direction from the support towards the first switch contact such that the contact carrier portion extends over at least part of the first switch contact; the movable structure overlaps with the control electrode; a second portion of the movable structure extends in a third direction from the support, the third direction being substantially opposed to the first direction, and where the second portion overlaps with a second control electrode and in which a spatial extent of the control electrode in a second direction perpendicular to the first direction is greater than the spatial extent of the movable structure in the second direction such that the control electrode extends beyond opposing sides of the movable structure in the second direction; and wherein the movable structure has an end remote from the support, and the control electrode extends beyond the end, except in a region of the contact carrier portion of the movable structure.

29. A MEMS component as claimed in claim 28 in which the second control electrode is configured to be selectively connected to a voltage in order to attract the second portion of the movable structure and thereby to urge the movable structure away from engagement with the first switch contact.

30. A MEMS component as claimed in claim 28 wherein the movable structure includes a depending contact configured to make contact with a contact surface separate from the control electrode, and wherein a height of the depending contact is 200nm to 400nm and a thickness of the movable structure is 7μm to 9μm to increase a peak stress that can be withstood before contact between the movable member and the control electrode.

31. A MEMS component as claimed in claim 28 in which the contact carrier portion carries a contact and one or both of a length of the contact carrier portion or a height of the contact are configured to reduce a force from charge trapped adjacent an edge of the control electrode to below a threshold value.

32. A MEMS component as claimed in claim 31 in which at least one of the contact carrier and the substrate adjacent the contact carrier have a surface recess formed therein.

* * * * *